United States Patent [19]

Wendt

[11] Patent Number: 4,934,829

[45] Date of Patent: Jun. 19, 1990

[54] METHOD OF DETERMINING RESONANT LENGTHS OF MICROWAVE SHIELDING MATERIAL

[75] Inventor: Dan J. Wendt, Shoreview, Minn.

[73] Assignee: The Pillsbury Company, Minneapolis, Minn.

[21] Appl. No.: 335,931

[22] Filed: Apr. 10, 1989

Related U.S. Application Data

[62] Division of Ser. No. 922,287, Oct. 23, 1986, Pat. No. 4,851,631.

[51] Int. Cl.[5] ..... G01K 11/12; H05B 6/80

[52] U.S. Cl. ..... 374/45; 219/105.5 D; 324/636; 340/600; 374/162

[58] Field of Search ..... 374/122, 149, 162, 45; 219/10.55 D, 10.55 E, 10.55 F, 10.55 M, 10.55 B, 201; 340/600; 324/95, 96

[56] References Cited

U.S. PATENT DOCUMENTS

| | | | |
|---|---|---|---|
| 3,586,970 | 6/1971 | Conway | 374/122 X |
| 3,864,976 | 2/1975 | Parker | 116/216 X |
| 3,865,301 | 2/1975 | Pothier et al. | 219/10.55 R X |
| 3,877,411 | 4/1975 | MacDonald | 116/216 X |
| 3,941,967 | 3/1976 | Sumi et al. | 219/10.55 R X |
| 4,009,359 | 2/1977 | Tallmadge et al. | 219/10.55 B |
| 4,122,324 | 10/1978 | Falk | 219/10.55 B X |
| 4,210,795 | 7/1980 | Lentz | 219/10.55 |
| 4,467,278 | 8/1984 | Toth et al. | 324/95 |
| 4,816,634 | 3/1989 | Lentz et al. | 219/10.55 B X |

*Primary Examiner*—Daniel M. Yasich

*Attorney, Agent, or Firm*—Arnold, White & Durkee

[57] ABSTRACT

A food container for use in a microwave oven is disclosed. The container contains a plurality of food substances, and employs a metal shield to shield at least one of the food substances from microwave radiation. Arcing and other problems associated with the use of metal shielding are avoided by proper selection of the geometry of the metal shield. The metal shield is preferably looped in a manner which provides some electrical inductance, and the ends of the metal shield are overlapped and separated by a dielectric material to provide some electrical capacitance. The geometry of the shield is selected so that the inductance and the capacitance in effect form a "tuned circuit" which minimizes problems associated with resonance and which eliminates arcing.

10 Claims, 28 Drawing Sheets

(DIMENSIONS OF A MICROWAVE SHIELD CRITICAL TO ELECTRICAL RESONANCE)

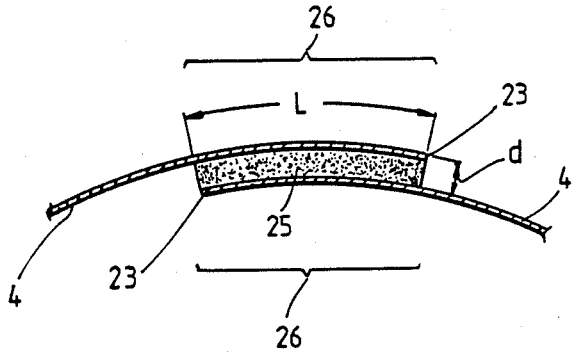
Fig. 3A
Fig. 4
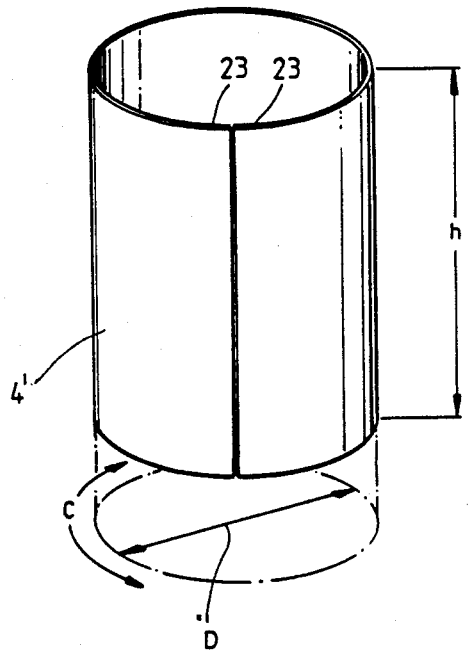

SEVERITY OF ARCING AT
DIFFERENT CAN HEIGHTS.

ARCING SUM
30
20
10
0
1.5 1.8 2.1 2.4 2.7 3.0 3.3 3.6 3.9 4.2 4.5
HEIGHT

RELATIVE ARCING POTENTIAL IN A
CYLINDRICAL FOIL SHIELD
(CHANGING CAPACITANCE
CHARACTERISTICS OF OVERLAP)

RELATIVE ARCING POTENTIAL
0.88 0.83 0.78 0.73 0.68 0.63 0.58 0.54 0.49 0.44 0.39 0.34 0.29 0.24
0.00 0.05 0.10 0.15 0.20 0.25 0.30 0.35 0.40 0.45 0.50
INCHES OF LABEL OVERLAP

RETRANSMITTED MICROWAVE
FIELD STRENGTH
(HEATING IN AN OVERLAPPED LABEL)
Fig. 9
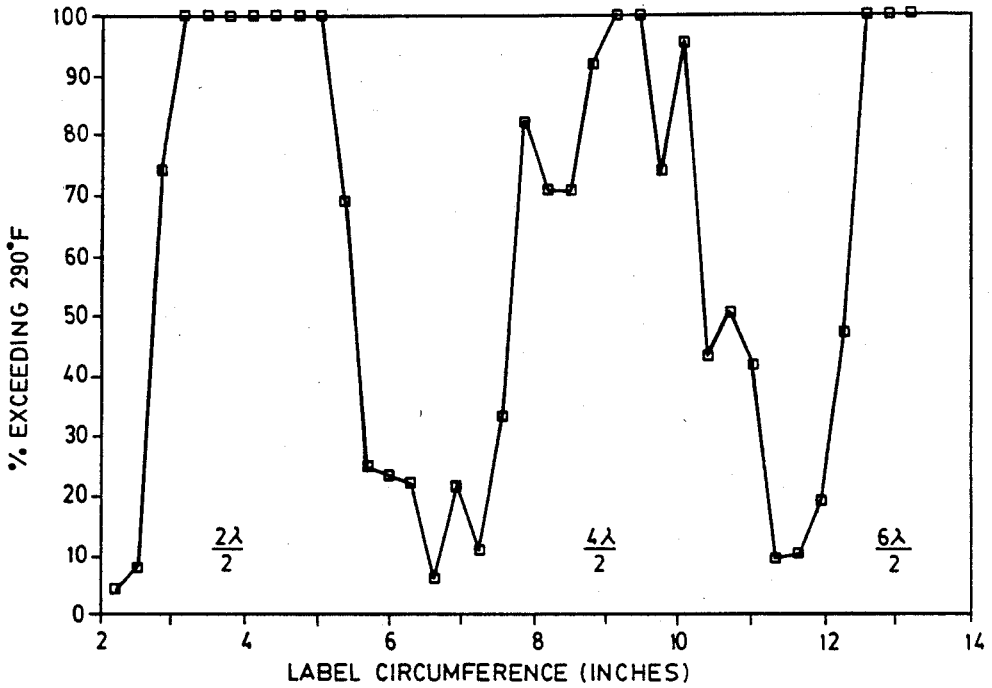
Fig. 14
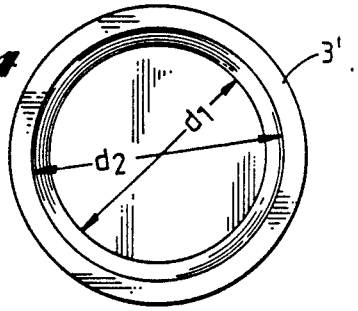
Fig. 12
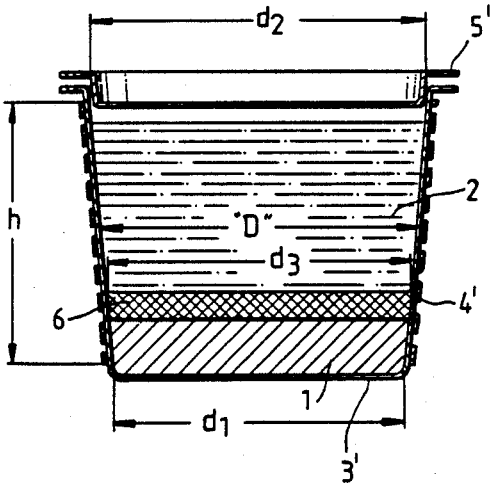
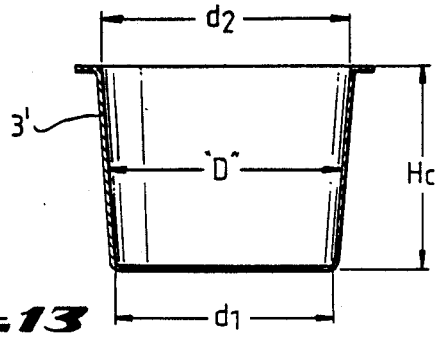
Fig. 13

ZV=1
*DIST=1.34
*XF=.94
*YF=1.16
EDGE
X=10000
MN=-9999
NCON=20
*VMIN=-10000
*VINC=1000

VOLTAGE LOADING
CASE 1 NO GAP

ZV=1
*DIST=.2
*XF=1.4
*YF=.19
EDGE
MX=10000
MN=5155
I=6000
J=8000

VOLTAGE LOADING
CASE 1 NO GAP

ZV=1
* DIST=1.34
* XF=.94
* YF=1.16
EDGE
MX=10000
MN=-9999
NCON=20
*VMIN=-10000
* VINC=1000

VOLTAGE LOADING
CASE 1 1/16 GAP

=1
*DIST=.2
* XF=1.4
*Y =.19
EDGE
MX=10000
MN=2111
H=4000
I =6000
J =8000

VOLTAGE LOADING
CASE 1 1/16 GAP

ZV=1
*DIST=1.34
*XF=.94
*YF=1.16
EDGE
MX=10000
MN=-9999
NCON=20
*VMIN=-10000
*VINC=1000

VOLTAGE LOADING
CASE 3 1/8 GAP

ZV=1
*DIST=.2
*XF=1.4
*YF=.19
EDGE
MX=10000
MN=2002
H=4000
I=6000
J=8000

VOLTAGE LOADING
CASE 3 1/8 GAP

ARCING IN A NON-OVERLAPPED FOIL LOOP

ELECTRICAL RESONANCES IN CONDUCTIVE STRIPS IN A MICROWAVE

RETRANSMITTED MICROWAVE FIELD STRENGTH (HEATING IN A NON-OVERLAPPED LABEL)

ARCING IN AN OVERLAPPED-FOIL LOOP

METHOD OF DETERMINING RESONANT LENGTHS OF MICROWAVE SHIELDING MATERIAL

CROSS-REFERENCE TO RELATED APPLICATIONS

This is a divisional of application Ser. No. 922,287, filed Oct. 23, 1986 (the entirety of which is incorporated by reference), now U.S. Pat. No. 4,851,631.

FIELD OF THE INVENTION

The present invention is directed to a method of determining resonant lengths of microwave shielding material used in a food container.

BACKGROUND OF THE INVENTION

The present invention relates to a package for heating a plurality of food materials in a microwave environment. In particular, shielding material is often used in instances where two or more different food materials are to be simultaneously heated in a microwave oven, but one food material requires more heat than another The process of heating one food material more than another is referred to as "differential heating." Differential heating could be accomplished by employing a conductive shield, if certain problems could somehow be avoided. In the past, when attempts were made to use metal in a food package for use in a microwave oven, sparks and popping noises would occur when the microwave oven was turned on. This is commonly called "arcing", and has been a problem for many years—usually circumvented by avoiding use of metal in a microwave food package. Severe arcing could cause the package to burn.

Some other problems associated with the use of a metal or conductive shield include, in addition to arcing, scorching of the product or package, melting the package, resonant retransmission, retransmission on the edges of the shield, burning the package, localized overheating, standing waves, and apparent leakage of microwaves into the package. Applicant discovered that these problems all appear to be associated with resonances in the conductive shield. The present invention involves determining resonant lengths of microwave shielding material so that arcing and other problems associated with resonance in a food container for a microwave environment may be avoided.

The problem of arcing has plagued the art for many years where attempts have been made to use metallic shields to accomplish differential heating of food substances by microwave energy. Applicant discovered that arcing can be substantially eliminated by selecting an appropriate geometry for the metallic components of the food package. This discovery allows metal shields to be conveniently used to accomplish differential heating of food material without arcing and without damaging the microwave oven.

A need has long existed for a satisfactory arrangement which would permit a variety of food substances to be simultaneously heated in a microwave oven. But different food substances present significant problems in package design in order to achieve proper heating of the respective food substances. While convenience and packaging concepts indicate a need for different foods to be packaged together in a single container, this is oftentimes rendered impossible as a practical matter because one food substance typically requires more or less microwave heating as compared to another. For example, a need has existed for an arrangement which would permit a combination of food, such as ice cream and a sauce, to be exposed to the heating effects of a microwave oven in such a manner that the sauce would become hot while the ice cream remained substantially frozen. Strawberry shortcake with whipped cream, or pie and ice cream are other examples. Broccoli and cheese sauce is yet another example of a food combination that advantageously would benefit from a suitable package which permitted differential heating. Other examples of the need for differential heating of food substances will be readily apparent to those skilled in the art.

In the past, it has been the general belief that metal containers should not be used to heat and cook food in microwave ovens. This general belief was recently reiterated in U.S. Pat. No. 4,558,198, which issued on Dec. 10, 1985, to Levendusky et al. Levendusky et al.'s recent disclosure included the following discussion:

> "It has been the general belief that metal containers should not be used to heat and cook food in microwave ovens. Bare metal containers can reflect the electromagnetic energy toward the magnetron (that supplies the energy to the oven cavity) and thereby damage the same. In addition, when bare metal is exposed in close proximity to the metal walls of a microwave oven, arcing between the container and oven walls occurs. For these reasons, the industry has generally advocated the use of plastic or cardboard containers to heat loads, e.g., foods, in microwave ovens."

Many others have recognized the problem of arcing in a microwave oven. For example, U.S. Pat. No. 4,122,324, issued to Falk, recognizes that slight imperfections in a metallic shielding film on a microwave food package may sometimes cause arcing. Falk says that arcing is "not uncommon" and can result from a scratch mark or even a small pin point in the metallic shielding film. Falk also discloses that other irregularities in the shape or edges of the shielding material can have the same effect because such irregularities, according to Falk, tend to concentrate the strength of the microwave field in those regions. Falk discloses that arcing presents a danger of fire because the temperatures generated in the region of the arc far exceed the flash point of the combustible material used to make the container or food package, which is typically made from thin cardboard, paper or the like.

While Falk recognizes the problem of arcing, Falk attempts to address the problem by coating the cardboard package to seal the package material from air and thereby minimize the tendency of the container to burn.

U.S. Pat. No. 4,439,656, issued to Peleg, recognizes arcing as a problem. Peleg addresses the problem by proposing an aluminum tray that is placed in a microwave transparent holder with a space between the tray and holder that is filled with water.

U.S. Pat. No. 3,854,021, issued to Moore et al., discloses a metal shield which lowers over part of a tray when the tray is inserted into the microwave oven. Moore et al. recognize that the shield distorts the microwave field in the oven and that arcing can result if the shield has sharp edges or is near the conductive wall of the oven. Moore et al. propose the use of Teflon tape on the lower edge of the shield to prevent arcing. The Moore et al. system for shielding is impractical for existing conventional microwave ovens because it would require substantial modification of an existing oven.

U.S. Pat. No. 4,558,198, issued to Levendusky et al., recognizes the significant problem of arcing. But Levendusky et al. say that a combination of four structures are needed to avoid arcing: (1) coating all surfaces of the tray with an organic coating at a very high film weight; (2) providing smooth curved wrinkle-free walls for the tray; (3) providing a round or oval shape in plan view such that there are no corners of the tray that are not curved or rounded with generous radii; and (4) providing a heat resistant plastic, microwave transparent dome or lid that covers the edges of the tray such that the edges are always physically separated and electrically insulated from the metal walls of the microwave oven. This reference actually teaches away from the present invention to the extent that Levendusky et al. instruct that all four structures are required to avoid arcing.

U.S. Pat. No. 4,351,997, issued to Mattisson et al., recognizes the problem of arcing. Mattisson et al. disclose that a traditional metallic tray is opaque to microwave radiation and is not suitable for use in microwave ovens which have no protection for the magnetron, because arcing may occur inside the oven cavity which may damage the magnetron. Mattisson et al. disclose a tray with aluminum foil laminate around the side walls of the tray.

U.S. Pat. No. 3,941,967, issued to Sumi et al., recognizes that aluminum foil may cause a "spark discharge" within a microwave oven. Sumi et al. disclose the use of an insulating body to prevent the occurrence of a spark discharge as a result of contact between the heating element and the inner wall of the oven.

Other proposals for use of metallic shielding to accomplish differential heating of food substances have been proposed. However, many older proposals have failed to even address the problem of arcing, much less solve that problem, and have not found significant commercial application to Applicant's knowledge. See, for example, U.S. Pat. No. 2,600,566, issued to Moffett, Jr.; and U.S. Pat. No. 2,714,070, issued to Welch. See also U.S. Pat. No. 4,081,646, issued to Goltsos. The difficulties involved in differentially heating various food substances in a single package led to the disclosure in U.S. Pat. No. 4,233,325, issued to Slangan et al., of a package which placed food substances in separate compartments sealed from one another. The wall between the compartments is punctured by a can opener or the like to mix the food substances after the food has been heated in a microwave oven and removed from the oven. Slangan et al. similarly ignore the problem of arcing, and fail to teach or suggest a solution to this problem.

None of the above-discussed references recognize the problem of resonance, and the other harmful effects associated therewith, such as localized overheating, scorching of the food material or the package, melting or burning of the package, edge overheating, retransmission, apparent leakage of microwaves into the package, standing waves, etc. By failing to recognize resonance as a problem, these references fall far short of addressing the problems solved by Applicant, and fall far short of obviously suggesting the solutions discovered by Applicant which are disclosed herein.

Because of the problem of resonance, and associated problems and effects including arcing and other problems enumerated above, metal shielding has found little use in commercial applications. Most microwave heating is still done in containers which are substantially transparent to microwave radiation and which contain no metal shielding.

Surprisingly, it has been found that the problems associated with resonance, including arcing, can be substantially eliminated and avoided while using a metal shield to accomplish differential heating of food material if the geometry of the shield is properly designed. Applicant discovered that the relationship between the wavelength of the microwave energy in the microwave oven and the dimensions of the shield could be properly controlled to avoid and to eliminate arcing, localized overheating, retransmitted fields, and other problems associated with resonance. Applicant has discovered that a metallic shield can be effectively used to accomplish differential heating of different food substances if the dimensions of the shield are intentionally selected in accordance with Applicant's teachings herein. Induced fields and parasitic currents which may occur in a metallic shield can be controlled if the teachings of this disclosure are followed.

Applicant also discovered that arcing and other problems can be eliminated by overlapping the ends of a metal shield in accordance with the teachings herein to effectively form an electrical damping arrangement. A practical shield may be typically formed by wrapping the metal shield around a container such that the ends of the shield overlap. Such overlapping is believed to in effect create capacitance that tends to damp voltages which would otherwise result in arcing. Overlapping tends to eliminate problems of arcing for half wavelength resonances, or odd multiples thereof. This is especially significant, because odd multiples of half wavelength resonances present the greatest potential for arcing. Overlapping therefore is an especially effective technique for eliminating arcing. The loop formed by wrapping the shield around the container in effect creates some inductance. A tuned circuit may be effectively formed from this combination of inductance and capacitance to control resonances in the metal shield.

The shield geometry should be designed to have nonresonant dimensions. It has been discovered that under circumstances where the shield becomes resonant, i.e., where the height, length, circumference, etc. of the shield is an integer multiple of a half wavelength, resonant voltages at the edges of the shield may be a prime cause of arcing. The discovery of the relationship between wavelength resonance of packaging materials and arcing has permitted metal shielding to be effectively used in packaging material while eliminating arcing. By eliminating the problems of arcing and other problems associated with resonance, metallic shields may now be used to allow a first food substance to be heated by microwaves while substantially reducing the exposure of a second food substance to the heating effects of the microwaves. Differential heating of two different food substances may thereby be accomplished with relative ease, without requiring substantial modifications to existing conventional microwave ovens.

SUMMARY OF THE INVENTION

Although the use of 915 MHz is permitted in North and South America by regulatory authorities, as well as other frequencies, most of the commercially available microwave food processing equipment is designed for operation at 2450 MHz. Virtually all home microwave ovens operate at a frequency of 2450 MHz. The nonresonant dimensions for a shield may be determined in accordance with the teachings herein for a given microwave frequency. However, if other microwave frequencies are used, the nonresonant dimensions for an effective shield will normally change accordingly.

A method of determining resonant lengths of microwave shielding material includes the steps of constructing a plurality of laminate test strips having a plurality of different lengths of conductive shielding material, which each length of conductive shielding material is bonded to a strip of lossy material and a strip of a temperature sensitive indicator. The laminate test strips are irradiated with microwave radiation for a predetermined period of time. The relative temperature indications of the temperature sensitive indicators of the strips are evaluated to determine the lengths of conductive shielding material which provide the maximum relative temperature indication. In this manner, the actual resonant wavelength for the shielding material is indicated by the length which provides the maximum relative temperature indication.

Where the wavelength "$\lambda_s$" of the microwave is used herein, it is defined as the actual resonant wavelength for the shield. Normally, the wavelength "$\lambda_s$" for the shield will be different from the wavelength "$\lambda_0$" of the microwaves in free space. This is due to differences in the speed of light through various mediums, end effects, resistivity, stray capacitances, dielectric properties, etc. The actual wavelength "$\lambda_s$" may be empirically determined using the method disclosed herein.

The present invention facilitates use of convenient and effective metal shielding to accomplish differential heating of various food materials in a microwave oven, while solving the problem of arcing which has plagued the art for many years. The present invention deals with the problem of resonance, and the undesirable effects thereof. The problems of resonance and retransmitted fields have not even been recognized by the references cited above; and it cannot be said that prior art references obviously suggest a solution to problems they do not even recognize.

BRIEF DESCRIPTION OF THE DRAWINGS

FIG. 3A shows a close-up cut-away top view of the overlapping portion of the shield shown in FIG. 3.

FIG. 4 is a perspective view of an alternative non-overlapping conductive shield, with the container omitted, to show the geometry of the shield.

FIG. 9 is a graph showing the relative heating of an overlapped shield as a function of circumference.

FIG. 12 is a cut-away side view of an alternative embodiment using a frustoconical container, including three different food substances.

FIG. 13 is a side view of an empty frustoconical container with the top removed.

FIG. 14 is a top view of the container shown in FIG. 13.

DETAILED DESCRIPTION OF A PREFERRED EMBODIMENT

Figure 1:
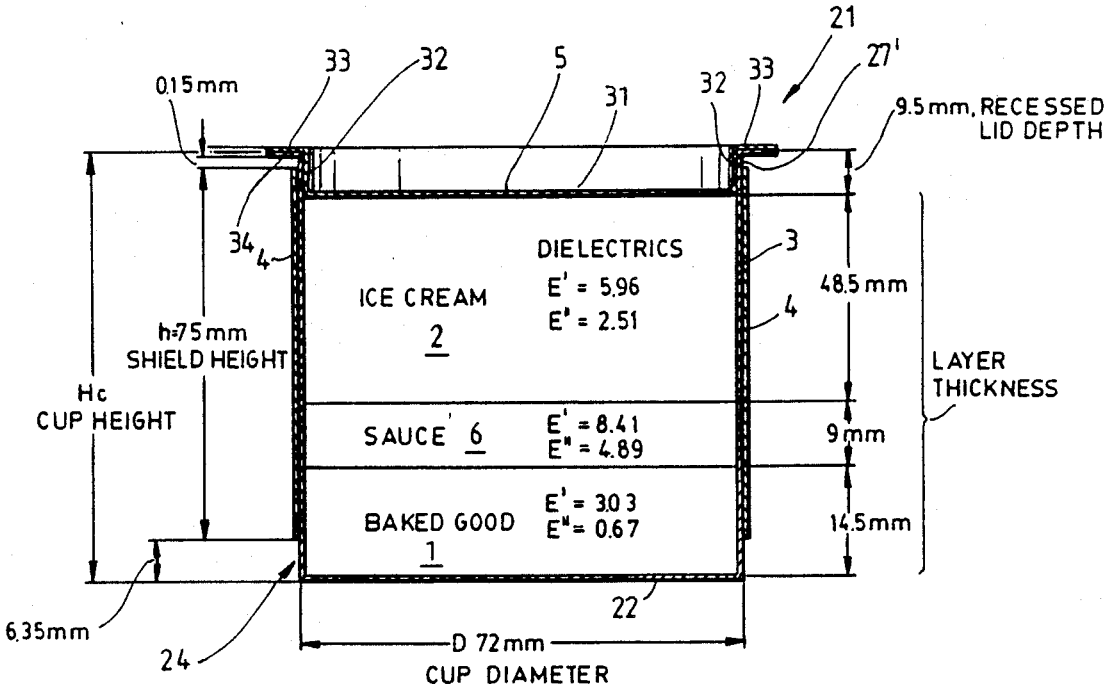
FIG. 1 is a cut-away side view of a preferred package including a container and three different food substances.

FIG. 1 shows a cut-away view of a presently preferred package 21 including a generally cylindrical container 3 for the differential heating of food material.

Inside the container 3 is placed a first food material 1, a second food material 2 and preferably a third food material 6. In a preferred embodiment of the invention, the first food material 1 may be a brownie 1 or other baked good. The second food material 2 may be ice cream 2 or other frozen food.

When the container 3 is placed in a microwave oven, it is desirable to heat the brownie 1 without heating the ice cream 2, (so that the ice cream 2 may remain in a frozen state while the package is exposed to microwave radiation). This differential heating is preferably accomplished by a conductive shield 4 around the container 3. The container 3 should be substantially transparent to microwave radiation. The conductive shield 4 is preferably formed from aluminum foil 4 wrapped around the container 3. The shield 4 prevents microwaves from entering the portion of the container 3 where the second food material 2, i.e., the ice cream 2, is contained. In other words, a shielded zone 2 is created within the container 3 by the shield 4.

Microwave radiation is allowed to enter the bottom 22 of the container 3 when the package 21 is placed in a microwave oven for heating. Microwave radiation is allowed to heat the brownie 1 which is not substantially shielded by the aluminum foil 4. In other words, the container 3 has an irradiation zone 1 which is exposed to microwave radiation.

The package also preferably includes a top or lid 5 which fits securely over the opening in the container 3, and may be heat sealed in a manner known in the art. The top 5 preferably includes a conductive shielding to further shield the ice cream 2 from microwave radiation. The lid 5 is preferably made from foil stock with serlyn laminated to it. The lid 5 could be made from foil stock with paper laminated to it.

The top 5 is preferably recessed into the container 3, as shown in FIG. 1. The top 5 preferably has a conductive horizontal center 31 surrounded by a vertical wall 32 which curves into a flange 33. The flange 33 may mate with a lip 34 on the container 3. The top 5 may be sealed or fastened to the container 3 in a suitable manner known in the art. The top 5 may be heat sealed on the flange 33.

A third food material 6 may be interposed between the brownie 1 and the ice cream 2. For example, the third food material 6 may be a sauce 6. The sauce 6 may offer advantages which enhance the temperature differential between the ice cream 2 and the brownie 1. For example, it will be explained more fully below that the sauce 6 may be chosen so that it is highly reflective of microwave energy, thereby further improving the differential heating between the brownie 1 and the ice cream 2. In other words, an edible reflective zone 6 may be formed inside the container 3 between the shielded zone 2 and the irradiation zone 1.

The illustrated container or cup 3 shown in FIG. 1 is generally cylindrical in shape, and has a height "$H_c$"and an outside diameter "D".

The package 21 illustrated in FIG. 1 normally would not be suitable for use in a conventional microwave oven due to the problem of arcing, unless the geometry of the shield 4 is carefully designed in accordance with the teachings of this invention. Resonance of the shield 4 at microwave frequencies must be generally avoided in order to minimize arcing and to avoid other problems, such as melting, localized overheating, etc. Applicant has discovered that the problem of arcing can be controlled and eliminated by carefully designing the shield geometry.

Figure 2:
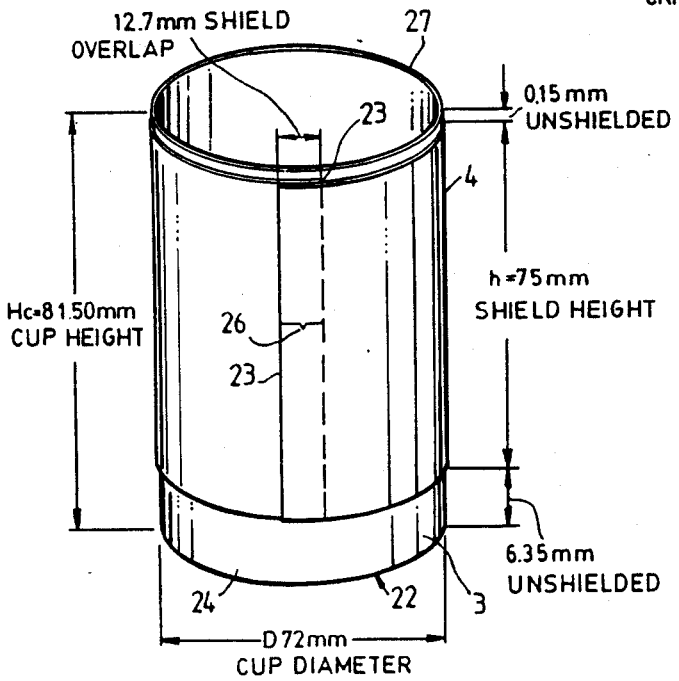
FIG. 2 is a perspective view of an empty container with an overlapping shield.

The shield geometry may be better explained by referring to FIG. 2, which illustrates a preferred embodiment of a shield 4. The shield 4 may be formed by wrapping aluminum foil 4 around the container 3. For a generally cylindrical container 3, the shield 4 is preferably formed from a rectangular piece of aluminum foil which has a length greater than the circumference of the container 3. When the shield 4 is wrapped around the container 3, the shield 4 assumes a generally cylindrical shape, and has a height "h" and a diameter "D". The shield 4 also has a circumference "C" equal to x multiplied times the diameter "D". Because the shield 4 is preferably formed from a length of aluminum foil which is greater than the circumference of the container 3, the ends 23 of the shield 4 will overlap. This is an important feature in achieving non-arcing operation of the shield 4, and will be explained more fully below.

The height "h" of the shield 4 will preferably be less than the height "$H_c$" of the container 3. This leaves an exposed lower wall 24 of the container 3, which is transparent to microwave radiation. Thus, microwave radiation is allowed to penetrate into the lower portion of the container 3 which contains the brownie 1. A more detailed illustration of the overlapping shield 4 is shown in FIG. 3.

Figure 3:
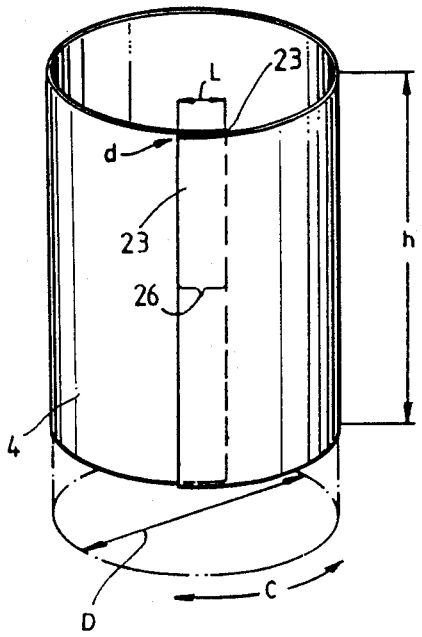
FIG. 3 is a perspective view of an overlapping conductive shield, with the container omitted, to show the geometry of the shield.

As shown in FIG. 3, the shield 4 has a height "h". The height "h" is measured in a direction parallel to the surface of the shield 4. In the illustrated embodiment shown in FIG. 2, the height "h" would be measured parallel to the wall of the container 3.

The container 3 illustrated in FIG. 2 has a circular cross-section. Thus, referring to FIG. 3, the shield 4 has a diameter "D" and a circumference "C" (equal to $\pi$ multiplied by D). When the shield 4 is wrapped around the container 3, the shield 4 conforms to the shape of the container 3, and therefore has a circular cross-section.

The shield 4 preferably has a generally cylindrical shape, conforming to the generally cylindrical shape of the preferred container 3. For a cylindrically shaped shield 4, the circumference "C" and diameter "D" of the shield 4 will be substantially uniform.

Referring to FIG. 3, the shield 4 preferably has overlapping ends 23 which overlap a distance "L". The overlapping ends 23 are separated by a distance "d". This is illustrated in more detail in FIG. 3A. The ends 23 of the shield 4 may be separated by a dielectric material 25. The dielectric material 25 has a dielectric constant "K".

Applicant has discovered that a non-arcing shielded package 21 for differential heating of food materials 1 and 2 with microwave radiation can be satisfactorily produced where the shield 4 has a geometry selected to avoid arcing. The shield 4 is selected so that the shield 4 has a height "h" which is substantially not equal to any multiple of a half wavelength of the microwave radiation. The shield 4 is further selected so that the shield 4 has a circumference "C" which is substantially not equal to any multiple of a half wavelength of the microwave radiation. This avoids resonance of the shield 4 at the frequency of the microwave radiation in order to minimize arcing and other problems associated with resonance.

For purposes of explanation, let us first consider a less preferred non-overlapping shield 4', which is illustrated in FIG. 4. The shield 4' is generally cylindrical in shape, and may be formed by wrapping aluminum foil around a generally cylindrical container 3. The length of the foil is substantially equal to the circumference "C" of the container 3.

Applicant has discovered that resonance is most likely to occur in a cylindrical non-overlapping shield 4 where:

$$\left(\frac{N}{h}\right)^2 + \left(\frac{M}{C}\right)^2 \text{ is equal to } \left(\frac{2}{\lambda_s}\right)^2$$

In this relationship, "h" is the height of the shield 4, "C" is the circumference of the shield 4', "$\lambda_s$" is the wavelength of the microwaves, and "N" and "M" are each integers, (for example, 0, 1, 2, 3, 4, etc.).

Arcing is most likely with odd multiples of "M", for example, M=1, 3, 5, 7, etc. This may be explained with reference to FIG. 25. At a resonant half wavelength, the voltages at the ends 35 of a conductive strip 36 have opposite polarities. Similarly, the voltages at the ends 35 of a strip 38 which is three half wavelengths will have opposite polarities. The voltages at the ends 35 of a strip 40 which is five half wavelengths will also be of opposite polarities. Thus, the greatest electrical potential difference between the ends 35 of a conductive strip 36, 38 or 40 exists when the strip 36, 38, or 40 is an odd multiple of a half wavelength. If, for example, the three half wavelength strip 38 is wrapped around a container 3 to form a shield 4' as shown in FIG. 4, the ends 23 of the shield 4' will have opposite polarity voltages induced therein, and arcing will likely be a significant problem.

Figure 25:
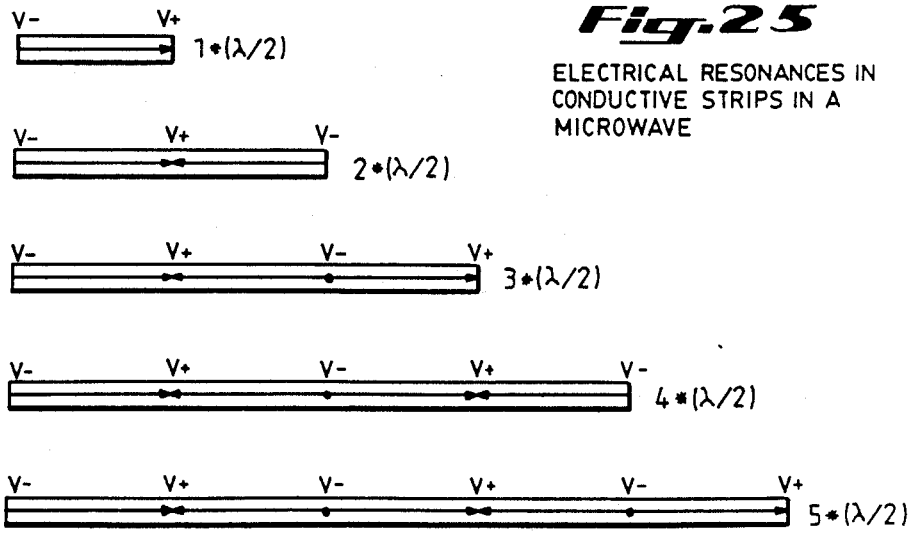
FIG. 25 is a schematic diagram illustrating the relationship between wavelength and voltage polarities at the ends of a metal shield.

When a conductive strip 37 resonates at a full wavelength, as shown in FIG. 25, the ends 35 of the strip 37 will have voltages of the same polarity. Similarly, when a conductive strip 39 is an even multiple of a half wavelength, voltages of the same polarity will be induced at the ends 35 of the strip 39. If the conductive strip 39 is wrapped around a container 3 to form a shield 4', as shown in FIG. 4, the voltages on the ends 23 of the shield 4' will have the same polarity. Because like charges repel, arcing is not as likely in this instance. However, other problems associated with resonance, such as localized overheating, melting, scorching, etc., may occur and are likely to be severe.

A non-arcing non-resonant shielded container 3 may be satisfactorily produced where the shield 4 is selected so that:

$$\left(\frac{N}{h}\right)^2 + \left(\frac{M}{C}\right)^2 \text{ is substantially not equal to } \left(\frac{2}{\lambda_s}\right)^2$$

Moreover, the conductive top 5 is preferably selected so that the diameter of the top is substantially to equal to any integer multiple of the half wavelength of the microwaves.

One way of expressing substantial inequality of the equation given above is that:

$$\left(\frac{N}{h}\right)^2 + \left(\frac{M}{C}\right)^2 \text{ is not equal to } \pm 10\% \text{ of } \left(\frac{2}{\lambda_s}\right)^2$$

for all integer values of N and M. A more preferred range is provided where:

$$\left(\frac{N}{h}\right)^2 + \left(\frac{M}{C}\right)^2 \text{ is not equal to } \pm 20\% \text{ of } \left(\frac{2}{\lambda_s}\right)^2$$

An even more preferred range is provided where:

$$\left(\frac{N}{h}\right)^2 + \left(\frac{M}{C}\right)^2 \text{ is not equal to } \pm 30\% \text{ of } \left(\frac{2}{\lambda_s}\right)^2$$

An especially preferred range is given where:

$$\left(\frac{N}{h}\right)^2 + \left(\frac{M}{C}\right)^2 \text{ is not equal to } \pm 40\% \text{ of } \left(\frac{2}{\lambda_s}\right)^2$$

Figure 5:
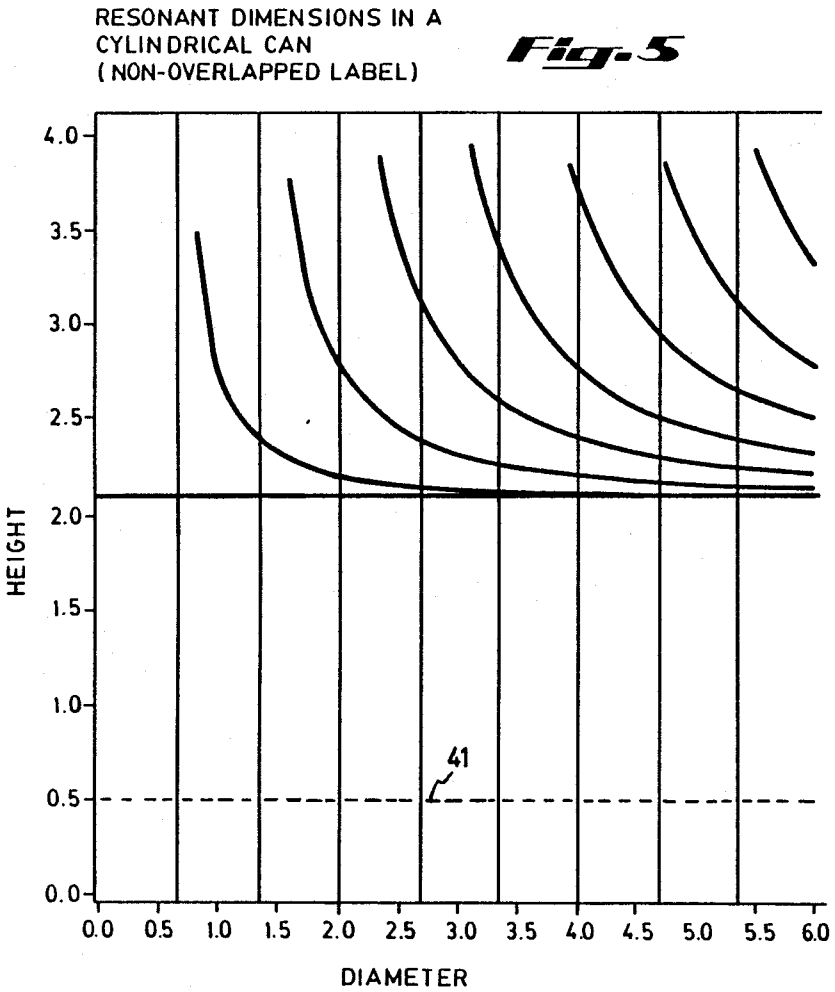
FIG. 5 is a graph depicting combinations of resonant geometries for a non-overlapped shield which are to be avoided.

FIG. 5 illustrates resonant geometries of the nonoverlapping shield 4' which should be avoided. For the expression:

$$\left(\frac{N}{h}\right)^2 + \left(\frac{M}{\pi D}\right)^2$$

the graph of FIG. 5 illustrates geometries of a generally cylindrical non-overlapping shield 4' which are susceptible to arcing. The graph assumes a microwave frequency of 2450 MHz. All dimensions on the graph are expressed in inches.

The lines drawn on the graph of FIG. 5 illustrate a series of points where:

$$\left(\frac{N}{h}\right)^2 + \left(\frac{M}{\pi D}\right)^2 = \left(\frac{2}{\lambda_s}\right)^2$$

In order to avoid arcing, combinations of shield 4' height "h" and diameter "D" which fall upon any line shown in the graph of FIG. 5 should be avoided. The lines drawn on the graph of FIG. 5 illustrate combinations of shield 4' height "h" and diameter "D" which are resonant at a typical microwave frequency of 2450 MHz. Points falling on these lines are to be avoided because those points represent instances where resonances may occur in the shield 4'. For example, the shield 4' could resonate in the direction of its height "h", and also in the direction of its circumference "C" (equal to $\pi$D), if the geometry of the shield 4' is selected so that the height "h" and diameter "D" fall upon one of the curved lines in FIG. 5.

The graph of FIG. 5 may be adjusted for end effects, etc. which affect the actual resonant wavelength $\lambda_s$ for the shield 4'. The actual resonant wavelength $\lambda_s$ for a particular material used for the shield 4' may be determined empirically, as will be explained more fully below. For example, if the resonant half wavelength for the actual material used for the shield 4' is 2.0 inches instead of 2.1 inches, the first horizontal line on the graph of FIG. 5 would be shifted down slightly. Similarly, the actual resonant wavelength $\lambda_s$ could shift the vertical lines to the left, (or to the right). The shape of the graph, however, should remain basically the same.

Figure 26:
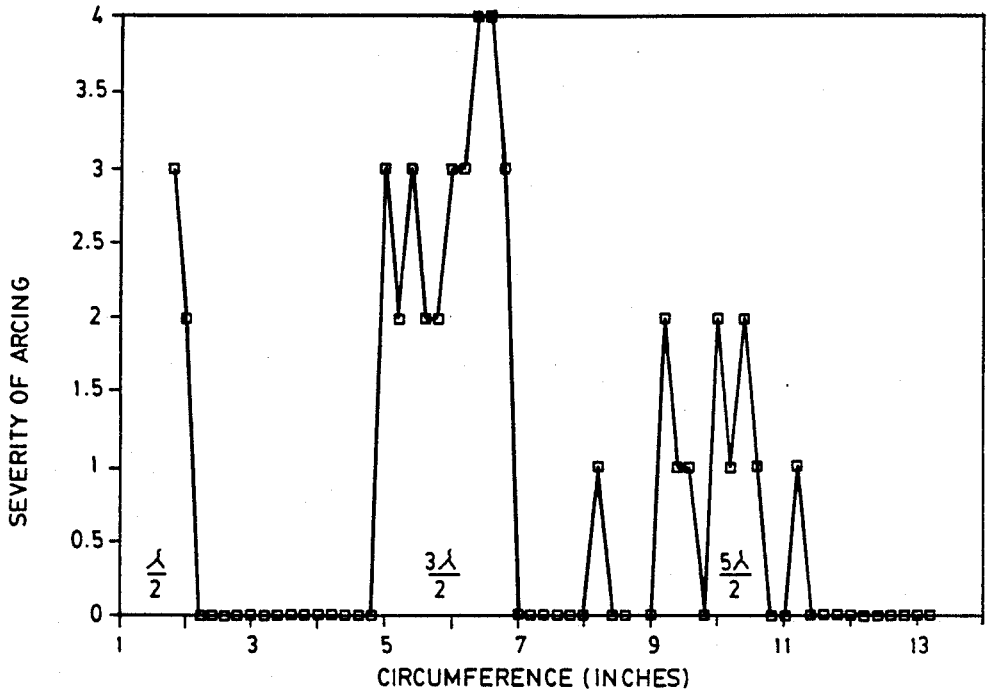
FIG. 26 is a graph showing the severity of arcing of a non-overlapping shielded container as a function of circumference.

The graph of FIG. 26 provides further experimental data for selecting a preferred circumference "C" of a non-overlapped shield 4'. This graph shows experimental results for one-half inch wide strips of foil, and plots severity of arcing as a function of the circumference of a shield. Conceptually, FIG. 26 may be thought of as an experiment corresponding to the dotted line 41 shown in FIG. 5 for a shield height "h" equal to one-half inch. The worst arcing occurs at odd multiples of a half wavelength. This corresponds to points where the dotted line 41 of FIG. 5 crosses the solid vertical lines. The results plotted in FIG. 26 also show arcing can be quite severe if resonance is approached.

Figure 27:
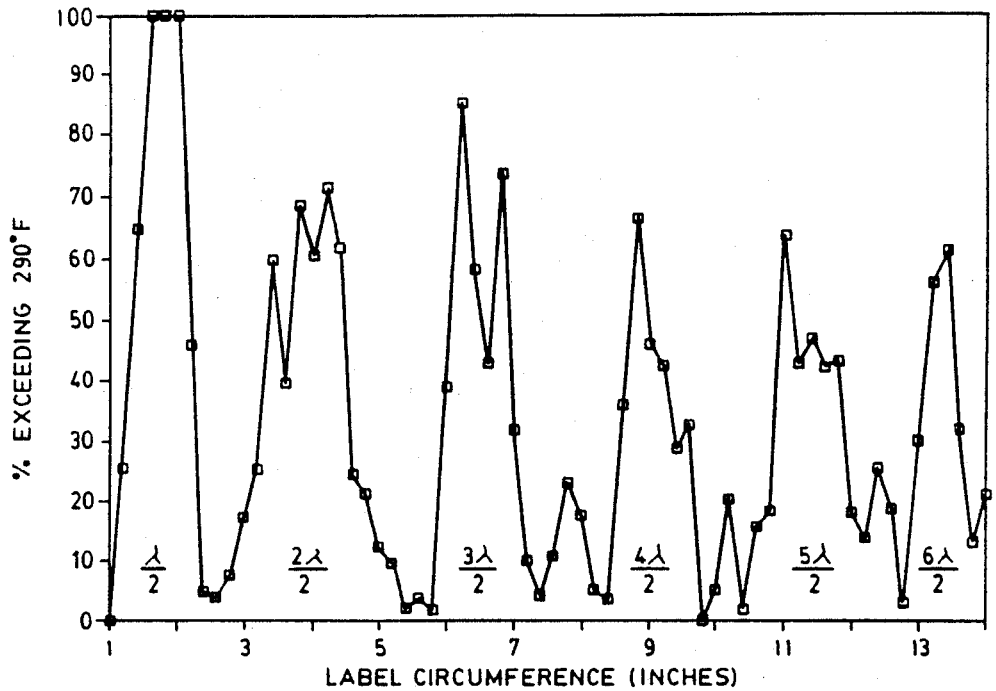
FIG. 27 is a graph showing the relative heating of a non-overlapped shield as a function of circumference.

FIG. 27 is a graph illustrating the effects of heating upon a non-overlapped shield 4', having a constant height "h" of one-half inch, as a function of the circumference "C" of the shield 4'. Even though arcing may not occur at even multiples of a half wavelength, (as shown by FIG. 26), the experimental data plotted in FIG. 27 shows that heating will occur at even multiples of a half wavelength.

The experiment plotted in FIG. 27 used several strips of metal foil having various lengths which were formed into loops having various circumferences. The metal strip was adhesively attached to a strip of lossy material, such as cardboard. A strip of temperature indicating material was affixed so that it overlaid the length of the metal strip. Suitable temperature indicating material includes cellulose acetate, which is a clear plastic-like material that turns dark when its temperature exceeds 290° F. The graph of FIG. 27 plots the percentage of the temperature indicating strip which exceeded 290° F., and thus turned dark.

FIG. 27 shows that substantial heating occurred at both even and odd multiples of a half wavelength. Such heating is undesirable, and can cause melting of the package, scorching of the package or food product, localized overheating of the food product, and other undesirable effects. The peaks on the graph of FIG. 27 correspond generally to the points where the dotted line 41 on FIG. 5 crosses the solid vertical lines, (although FIG. 27 plots circumference and FIG. 5 plots diameter). The geometry of the shield 4' should be selected to avoid these peaks of heating.

Returning now to a discussion of the preferred embodiment of the shield 4 illustrated in FIG. 3, significant advantages are realized by overlapping the ends 23 of the shield 4. The overlapping portion 26 of the ends 23 of the shield 4 effectively form parallel conductive plates 26 separated by a dielectric material 25. As shown in more detail in FIG. 3A, the ends 23 of the shield 4 in effect form a capacitor with dielectric material 25. It is believed that this capacitance tends to electrically dampen some resonant voltages which might otherwise tend to cause arcing. The shield 4 forms a loop, as shown in FIG. 3, which has some inductance. Thus, a "tuned circuit" can be formed with the shield 4 by carefully selecting the shield geometry. By adjusting the geometry of the shield 4, the "tuned circuit" effectively formed by the overlapping shield 4 may be tuned to control the tendency of microwaves of a particular frequency to cause arcing by inducing voltages in the shield 4. The "tuned circuit" effectively formed may also be tuned to control other undesirable effects of resonance.

The overlapping shield 4 illustrated in FIG. 3 tends to eliminate arcing that occurs at odd multiples of half wavelengths of the microwave radiation. The voltages induced on the overlapping ends 23 of the shield 4 will be of opposite polarity. But the overlapping ends 23 effectively form a capacitor. As long as the field strength across the capacitor does not exceed the breakdown voltage of the capacitor, the capacitor formed by the overlapping ends 23 of the shield 4 will not allow arcing. The capacitor effectively formed will store and release a charge resulting from the induced currents. The dielectric material 25 and separation distance "d" may be selected to provide a sufficiently high breakdown voltage. The greater the distance "d", the larger the breakdown voltage.

It is believed that the polarity of the instantaneous electrical voltage which may be induced on the ends 23 of the shield 4 in response to microwave radiation will be the same for full wavelength multiples of resonant dimensions. Due to the same polarity, and the phenomenon that like charges repel, arcing is believed to be avoided for full wavelength multiples of the circumference "C" of the shield 4. Overlapping the ends 23 of the shield 4 in the manner described effectively eliminates the problem of arcing which would otherwise occur at odd multiples of a half wavelength; (see, for example, FIG. 26).

Figure 28:
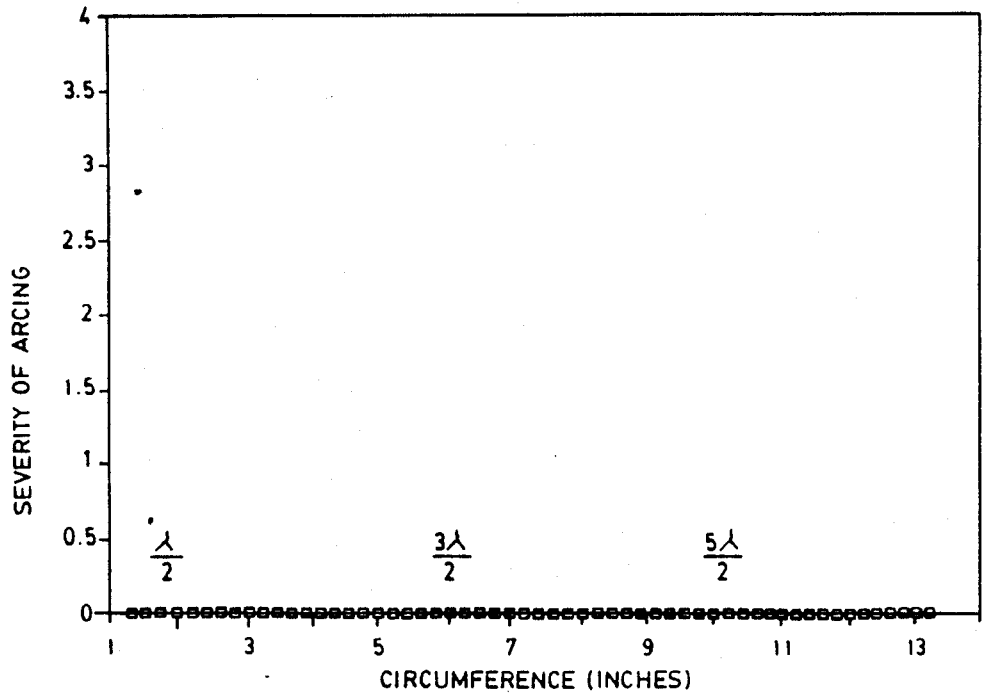
FIG. 28 is a graph showing the severity of arcing of an overlapping shielded container as a function of circumference.

This may be explained in more detail with reference to FIG. 25. At odd multiples of a half wavelength, resonant voltages induced in a metal shield 4 have opposite polarities on the ends of the metal strip. When the strip of metal is formed into a non-overlapping loop 4', as shown in FIG. 4, the maximum potential to arc is created. Overlapping the ends 23 of the shield 4, as shown in FIG. 2, eliminates the problem of arcing at odd multiples of a half wavelength. This technique alone will substantially eliminate arcing, provided a resonant shield height "h" is avoided. This is illustrated graphically in FIG. 28. FIG. 28 shows that no arcing will occur with an overlapping shield 4. This may be compared with FIGURE 26, showing the results for a non-overlapped shield 4'. The overlapped shield 4 eliminates arcing at odd multiples of a half wavelength.

Applicant has discovered that a non-arcing shielded package 21 may be satisfactorily produced from a generally cylindrical container 3 where a preferred overlapping shield 4 is provided having a geometry selected so that:

$$\left(\frac{N}{h}\right)^2 + \left(\frac{2M}{C}\right)^2 \text{ is substantially not equal to } \left(\frac{2}{\lambda_s}\right)^2$$

One way of expressing substantial inequality of the equation given above is that:

$$\left(\frac{N}{h}\right)^2 + \left(\frac{2M}{C}\right)^2 \text{ is not equal to } \pm 10\% \text{ of } \left(\frac{2}{\lambda_s}\right)^2$$

for all integer values of N and M. A more preferred range is provided where:

$$\left(\frac{N}{h}\right)^2 + \left(\frac{2M}{C}\right)^2 \text{ is not equal to } \pm 20\% \text{ of } \left(\frac{2}{\lambda_s}\right)^2$$

An even more preferred range is provided where:

$$\left(\frac{N}{h}\right)^2 + \left(\frac{2M}{C}\right)^2 \text{ is not equal to } \pm 30\% \text{ of } \left(\frac{2}{\lambda_s}\right)^2$$

An especially preferred range is given where:

$$\left(\frac{N}{h}\right)^2 + \left(\frac{2M}{C}\right)^2 \text{ is not equal to } \pm 40\% \text{ of } \left(\frac{2}{\lambda_s}\right)^2$$

The expression $$\left(\frac{2M}{C}\right)^2$$

is equivalent to the expression $$\left(\frac{2M}{\pi D}\right)^2$$

based on the relationship that the circumference "C" equals $\pi$ multiplied times the diameter "D".

Figure 6:
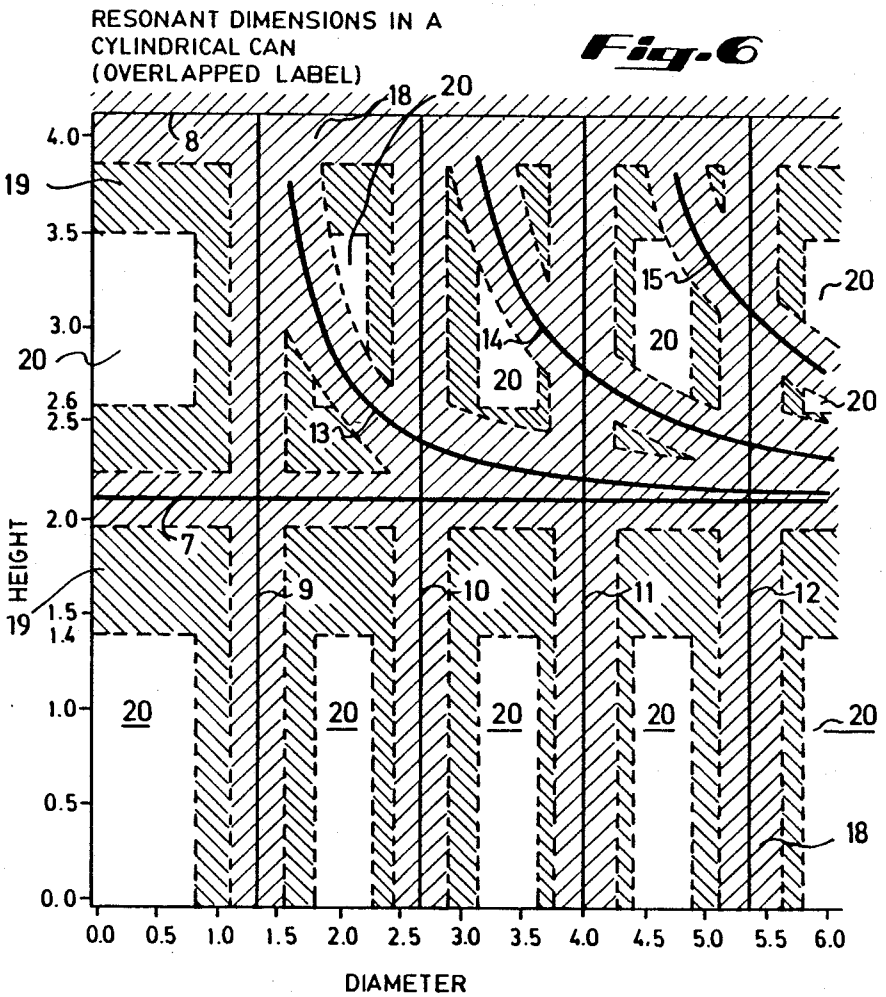
FIG. 6 is a graph depicting combinations of resonant geometries for an overlapped shield which are to be avoided.

FIG. 6 illustrates resonant geometries of the shield 4 which should be avoided. For the formula:

$$\left(\frac{N}{h}\right)^2 + \left(\frac{2M}{\pi D}\right)^2 = \left(\frac{2}{\lambda_s}\right)^2$$

the graph of FIG. 6 illustrates geometries of a generally cylindrical overlapping shield 4 which are susceptible to arcing. The graph assumes a microwave frequency of 2450 MHz. All dimensions on the graph are expressed in inches.

The advantage of an overlapped shield 4 are further illustrated by comparing FIG. 6 with FIG. 5. The vertical lines representative of odd multiples of half wavelengths in FIG. 5 are eliminated from FIG. 6 due to overlapping. Similarly, every other curved line in FIG. 5 is eliminated from FIG. 6.

The line drawn on the graph of FIG. 6 identified with reference numeral 7 illustrates the example solution to the above formula where N=1 and M=0. The line illustrated and identified by reference number 8 illustrates the example where N=2 and M=0. Similarly, line 9 illustrates the solution for the equation where N=0 and M=1. Line 10 illustrates the solution for the equation where N=0 and M=2. Line 11 represents points where N=0 and M=3. Line 12 illustrates graphically the instances of a cylindrical shield 4 where N=0 and M=4.

The curve illustrated in FIG. 6 and identified by reference numeral 13 illustrates the solution for the equation where N=1 and M=1. Curve 14 shows examples where N=1 and M=2. Similarly, curve 15 shows examples of a cylindrical shield 4 where N=1 and M=3.

The graph of FIG. 6 also applies to frustoconical shields 4 where "D" represents the mean diameter of the shield 4. Alternatively, the shield 4 should not have any diameter within the range of minimum to maximum diameters which falls upon any point on lines 7, 8, 9, 10, 11, 12, 13, 14 or 15.

To avoid problems associated with resonance, shield geometries with combinations of heights and diameters which correspond with any point on lines 7, 8, 9, 10, 11, 12, 13, 14, or 15 should normally be avoided. In a preferred package in accordance with the present invention, instances where the height "h" and diameter "D" of the shield 4 approach the resonance lines 7 through 15 should be substantially avoided by a preselected margin of error, as illustrated in FIG. 6 by the first shaded areas 18. An even more preferred margin of safety is provided by avoiding combinations of height "h" and diameter "D" which fall in the second broader shaded areas 19.

Another way of more specifically describing the broader shaded areas 19 which provides a more preferred margin of safety is to specify the approximate values of height "h" and diameter "D" which bound the area 19, assuming a microwave frequency of 2450 MHz. In a more preferred embodiment, heights "h" within the range of about 1.4 to about 2.6 inches should be avoided. Similarly, heights "h" within the range of about 3.5 to about 4.7 inches should also be avoided. In a more preferred embodiment, diameters "D" within the range of about 0.89 to about 1.79 inches should be avoided. Diameters "D" within the range of about 2.23 to about 3.13 inches should preferably be avoided. Diameters "D" within the range of about 3.57 to about 4.47 inches should preferably be avoided. Preferably, diameters "D" within the range of about 4.91 to about 5.81 inches should also be avoided.

In other words, the geometry of the shield 4 should most preferably be selected so that it has a combination of a height "h" and a diameter "D" which falls within the unshaded area 20 of the graph of FIG. 6. A more preferred non-arcing package may have a height "h" within the range of about 0 to about 1.4 inches and a diameter "D" within the range of about 0 to about 0.9 inch. A more preferred non-arcing package may have a height "h" within the range of about 2.6 to about 3.5 inches and a diameter "D" within the range of about 0 to about 0.9 inch. A more preferred package may have a height "h" within the range of about 0 to about 1.4 inches and a diameter "D" within the range of about 1.8 to about 2.2 inches. Alternatively, a more preferred package may have a height "h" within the range of about 0 to about 1.4 inches and a diameter "D" within the range of about 3.1 to about 3.6 inches. Another alternative more preferred package may have a height "h" within the range of about 0 to about 1.4 inches and a diameter "D" within the range of about 4.4 to about 4.9 inches.

A more preferred non-arcing package with an overlapping shield 4 may have a height "h" within the range of about 2.6 to about 3.5 inches, and a diameter "D" within the range of about 1.8 to about 2.2 inches. In this particular example, combinations of height "h" and diameter "D" should be avoided where $$\left(\frac{1}{h}\right)^2 + \left(\frac{2}{\pi D}\right)^2 = \pm 10\% \text{ of } \left(\frac{2}{\lambda_s}\right)^2$$

Alternatively, the shaded area 18 around the curve 13 should be avoided as illustrated in FIG. 6.

In yet another more preferred embodiment, the package may have a height "h" within the range of about 2.6 to about 3.5 inches, and a diameter "D" within the range of about 3.1 to about 3.6 inches. In such a package, the combination of the height "h" and the diameter "D" should be selected so that $$\left(\frac{1}{h}\right)^2+\left(\frac{4}{\pi D}\right)^2 \text{ is not equal to } \pm 10\% \text{ of } \left(\frac{2}{\lambda_s}\right)^2$$

Alternatively, the shaded area 18 illustrated around the curve 14 shown in FIG. 6 should be avoided.

A more preferred package may alternatively have a height "h" within the range of about 2.6 to about 3.5 inches, and a diameter "D" within the range of about 4.4 to about 4.9 inches. Combinations of height "h" and diameter "D" should be selected such that $$\left(\frac{1}{h}\right)^2+\left(\frac{4}{\pi D}\right)^2$$

is not equal to any value within the range of ±10% of $$\left(\frac{2}{\lambda_s}\right)^2,$$

and $$\left(\frac{1}{h}\right)^2+\left(\frac{6}{\pi D}\right)^2$$

is not equal to any value within the range of ±10% of $$\left(\frac{2}{\lambda_s}\right)^2.$$

Alternatively, the shaded area 18 around the curves 14 and 15 illustrated in FIG. 6 should preferably be avoided.

Of course, the diameter "D" of the shield and the circumference "C" of the shield are related by the relationship $C=\pi D$. Thus, it will be appreciated that the relationship between the height, diameter and wavelength and the relationship between the height, circumference and wavelength are equivalent.

All of the above examples have been described with reference to a generally cylindrical shield 4 with an overlap. The above discussion also applies to a generally frustoconical shield 4' with an overlap as shown in FIG. 12 where the range of diameters from the smallest diameter "$d_1$" through the largest diameter "$d_2$" are all within the range specified for the diameter "D".

Figure 7:
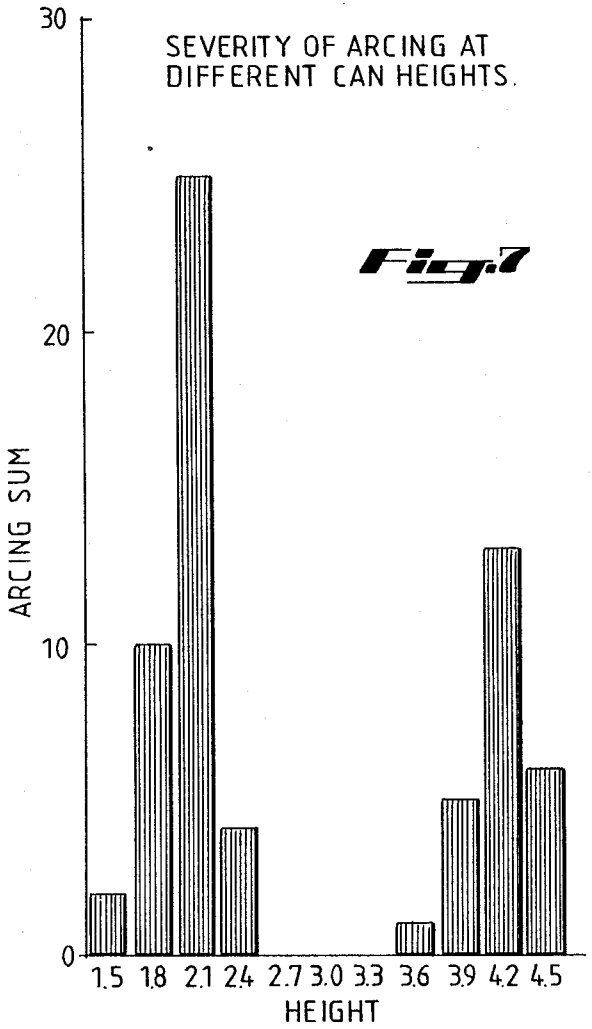
FIG. 7 is a graph illustrating the severity of arcing at different container heights.

Reference may also be made to FIG. 7 for heights "h" which should be avoided. FIG. 7 illustrates graphically the severity of arcing as a function of the height of the shield 4. The graph illustrates that the most severe arcing occurs for shield 4 heights "h" of 2.1 inches and 4.2 inches. At a microwave frequency of 2450 MHz, 2.4 inches and 4.8 inches corresponds to one-half wavelength and a full wavelength "$\lambda_0$", respectively, at that frequency in free space. The resonant half wavelength in the shield 4 height "h" is about 2.1 inches. The resonant wavelength "$\lambda_s$" for the shield 4 height "h" is about 4.2 inches. The resonant wavelength "$\lambda_s$" for the shield 4 is related to the wavelength "$\lambda_0$" in free space by a constant factor "K". The relationship will be described in more detail below. It should be noted that the resonant dimensions for a shield 4 will not be the same as the theoretical wavelength "$\lambda_0$" in free space. FIG. 7 shows that substantially no arcing occurred for heights "h" within the range of about 2.6 to about 3.5 inches.

In the preferred embodiment utilizing Applicant's "overlapping" technique illustrated, for example, in FIG. 3, Applicant has discovered that a relative arcing potential may be defined as:

$$\frac{1}{\sqrt{1+\frac{DhLK}{4d\lambda_0^2}}}$$

where "D" is the diameter of the shield, "h" is the height of the shield, "L" is the distance that the first end of the shield overlaps the second end of the shield, "K" is the dielectric constant of the dielectric material between the first and second ends of the shield, "d" is the distance that the first and second ends of the shield are spaced apart, and "$\lambda_0$" is the wavelength of the microwave radiation. The arcing potential should be minimized by selecting dimensions for the shield which reduce the value of the arcing potential to a level where arcing is substantially avoided. Experiments have shown that satisfactory results may be obtained with a relative arcing potential in a range of about 0.8 to about 0. Arcing occurred for relative arcing potentials in excess of 0.8. Dimensions for an overlapping shield 4 providing a relative arcing potential of about 0.7 to about 0 give good results, and a relative arcing potential in the range of about 0.6 to about 0 provides better results. The dimensions for the shield are preferably selected so that the value for the arcing potential is in the range of about 0 to about 0.5. A range of about 0 to about 0.4 is more preferred for the arcing potential. A value for the arcing potential in the range from about 0 to about 0.3 is even more preferred. A value for the arcing potential in the range of about 0 to about 0.2 is especially preferred. A value for the arcing potential in the range of about 0 to about 0.1 is even more especially preferred.

An overlap distance "L" of about 12.7 millimeters is preferred for the overlapped shield 4. A shield height "h" of about 75 millimeters (or about 2.95 inches) is preferred. A shield diameter "D" of about 70 millimeters (or about 2.75 inches) is preferred.

Whenever the wavelength "$\lambda_s$" is mentioned herein, it is to be understood that "$\lambda_s$" is intended to refer to the actual wavelength of the microwaves. Of course, the wavelength of the microwaves is inversely related to the frequency. As the frequency increases, the wavelength will become shorter. But the wavelength is also affected by the properties of the material through which the microwaves may travel. The wavelength of microwaves of a given frequency may be different in free space as compared with, for example, the effective wavelength in an aluminum foil shield. In free space, the wavelength $\lambda_0$ is related to the frequency "f" by the following relationship: $\lambda_0=11{,}800\div f$; where $\lambda_0$ is the wavelength in free space expressed in inches, and f is the frequency in megahertz.

Of course, the above formula provides the wavelength $\lambda_0$ in free space. The wavelength in air may be different from the wavelength $\lambda_0$ in free space. For purposes of the present invention, that difference is not significant. In other words, the wavelength $\lambda_0$ in free space is for practical purposes the same as the wavelength in air.

For purposes of avoiding arcing due to resonant dimensions in the shield 4, the value of $\lambda_s$ used for the wavelength in the above relationships should be determined for the specific material used for the shield 4. The value for the actual wavelength $\lambda_s$ may be expressed as $\lambda_s = k\lambda_0$, where $\lambda_s$ is the actual wavelength for the shield 4, k is a correction factor, and $\lambda_0$ is the wavelength of the microwaves in free space. The correction factor k may be empirically determined.

Figure 30:
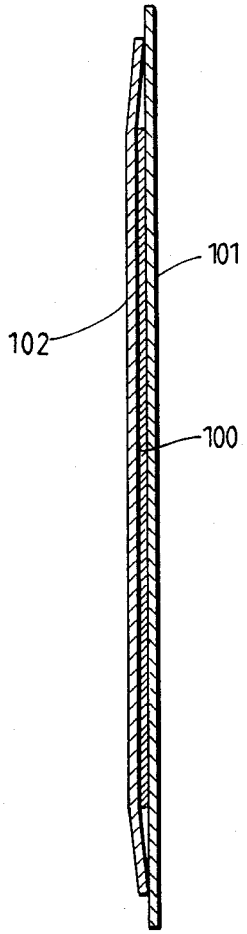
FIG. 30 is a side view of a laminate test strip.
Figure 29:
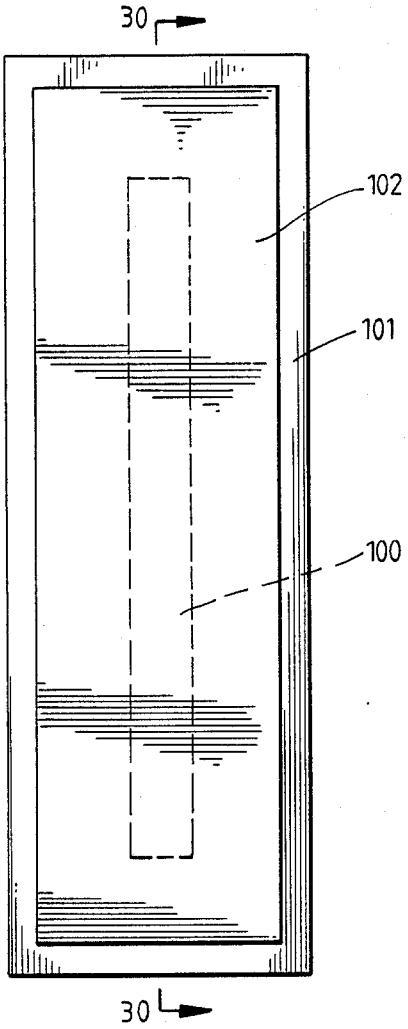
FIG. 29 is a top view of a laminate test strip.

A suitable method for determining the correction factor k involves taking strips of various lengths of the material utilized for the shield 4. Referring to FIGS. 29 and 30, if aluminum foil is used for the shield 4, for example, various lengths of aluminum foil are cut into strips 100. Preferably, the strips 100 of aluminum foil should be varied in length by increments of one millimeter, and should have a substantially uniform width. The width of the strips 100 should not approach a resonant distance; otherwise the results of the method will be unduly complicated. A width of one-half inch is preferred. It is substantially less than a half wavelength. Therefore, complex resonances are of no concern.

The strips 100 of aluminum foil may then be taped, bonded or otherwise affixed to a lossy material 101, for example, cardboard. The lossy material 101 will be heated by the retransmitted microwave field induced by currents in the strip 100 of aluminum foil and will assist in determining the resonant dimensions of the strips 100 of aluminum foil. An indicator 102 of the amount of heating is placed over the top of the strip 100 of aluminum foil. A temperature sensitive material or temperature indicator 102 such as cellulose acetate has been used for this purpose with good results. The various length strips 100 are then exposed to microwave radiation for identical periods of time. Exposure times of ten seconds have given good results in practice. The extent to which the temperature indicator 102 changes color or otherwise indicates heating may then be observed and quantified to determine the length of foil 100 which heats the most, and therefore is the resonant length of foil 100. The cellulose acetate temperature sensitive material 102 indicates resonance by turning black in response to heating. The length of strip 100 which provides the maximum relative indication of heating is considered to be the resonant length of aluminum foil. In experiments of this type, it has been found that when a resonant length of an aluminum foil strip 100 is tested, the cellulose acetate indicator 102 will typically turn completely black. The resonant length is measured. The correction factor "k" is then determined by dividing the actual resonant length as measured, i.e., determined empirically, by the theoretical wavelength in free space.

The correction factor "k" is believed to be affected by the resistivity of the material used to form the shield 4, and by end effects. The correction factor "k" may also be affected by stray capacitances, and the dielectric properties of the materials around the shield 4; however, these latter factors are not believed to be significant. The thickness of the shield 4 does not appear to have a significant effect upon the correction factor "k", for a typical range of thicknesses.

End effects are more pronounced at smaller multiples of a half wavelength, i.e., for small integer values of "N" and "M" in the above equations. For example, aluminum foil was tested, and resonant lengths were measured and the correction factors "k" were determined. The following results were obtained:

| wavelength | k factor |
|---|---|
| 1/2λ | 0.69 |
| 1λ | 0.86 |
| 3/2λ | 0.88 |
| 2λ | 0.88 |
| 3λ | 0.87 |
| 4λ | 0.90 |

End effects appear to have the most effect for one-half wavelength, which yielded a "k" factor of 0.69. The "k" factor tends to generally increase for larger multiples of wavelengths, approaching a limiting value of 0.90. The slight reduction in the "k" factor observed above for 3λ is within the range of experimental error.

The correction factor "k" may vary depending upon the material. Metallized mylar susceptors were tested for resonance, and yielded a "k" factor of 0.29 for one-half wavelength, 0.27 for one wavelength, and 0.31 for one and one-half wavelengths.

Another aspect of resonance which should be briefly mentioned involves the phenomenon of "retransmitted fields." While arcing has been recognized in the art as a significant problem, retransmitted fields induced in the shield 4 at resonance can cause localized overheating, scorching, melting, and other problems.

The shield's exterior geometry is not the only concern for effective differential heating using a conductive shield 4. If the interior dimensions of a shielded container 3 resonate at the microwave frequency, undesirable heating of the food substances 1, 2 or 6 may occur. If the dimensions of the internal geometry of the shield 4 are properly selected, the shield 4 may function as a waveguide. The shield 4 if it behaves as a waveguide, may control the direction of the microwaves entering the package in the interior of the container 3, which tend to heat the food material 2. The effective wavelength of microwaves in the food materials 1, 2 and 6 should be considered to determine the dimensions which will result in the interior of the shield functioning as a waveguide.

In a preferred embodiment, attention must be given to the effective wavelength of the microwaves in the food substances 2, 1 and 6 which are present in the container 3. For purposes of discussion, we may refer to the effective wavelength of microwaves in the food substance held within the container 3, such as the ice cream 2, as "$\lambda_1$". The wavelength $\lambda_1$ will be affected by the properties of the food substances 1, 2 and 6 in the container 3. Each food substance 1, 2 or 6 has a dielectric property. The higher the dielectric, the shorter the wavelength $\lambda_1$ will be of the microwaves in the food substances 1, 2 and 6. The dielectric properties of the food materials 1, 2 and 6 should be measured. The diameter "D" and thickness of the food substance 2 should be selected to avoid resonances which would induce undesired heating of the ice cream 2.

The dielectric properties of a food substance 1 may be measured using techniques which are known in the art. For example, a Hewlett Packard 8753A microwave network analyzer may be used. Once the dielectric of the food substance 1 or 2 has been determined, the wavelength $\lambda_1$ of the microwaves within that food substance may then be calculated. Thus, in avoiding resonant dimensions, especially in the diameter and thickness of the ice cream 2, it may sometimes be necessary to account for the differences in the wavelength $\lambda_1$ in the food substance 2 immediately adjacent the shield 4 to the extent that the wavelength $\lambda_1$ is different from the wavelength of the microwaves in free space. In such instances, the dimensions of the container 3 may need to be adjusted in view of the actual wavelength $\lambda_1$ in the food substance 2 within the container 3, which will determine the resonant dimensions for the food substance 2.

In a preferred embodiment, the brownie 1 characteristics should be selected to enhance absorption and the sauce 6 characteristics should be selected to enhance reflectance.

The sauce 6 preferably has characteristics which cause it to function as an edible reflective layer. If the sauce 6 has a high impedance relative to a low impedance ice cream layer 2 and a low impedance brownie layer 1, this low impedance/high impedance/low impedance interface enhances the action of the sauce 6 as a reflective layer. If the thickness of the sauce layer 6 is selected to be about one-half wavelength thick, constructive interference will be enhanced between microwaves reflected on both interfaces between the sauce 6 and the ice cream 2, and between the sauce 6 and the brownie 1. Reflection of microwaves back to the brownie 1 will be enhanced. This will have a favorable effect upon the temperature differential between the brownie 1 and the ice cream 2. Enhancing reflection will reduce the amount of microwaves which reach the ice cream 2.

Absorption of the brownie 1 may be optimized or enhanced by considering the dielectric loss factor (E″) of the brownie 1. Reflectance of the sauce layer 6 may be enhanced by considering the index of refraction.

In summary, the temperature differential between the brownie 1 and the ice cream 2 may be enhanced or optimized by considering layer thickness, layer diameter, and dielectric properties of the brownie 1, ice cream 2 and sauce 6 layers.

The preferred dielectric properties for the ice cream 2 are a value of dielectric constant (E′)=5.96 and a value of dielectric loss factor (E″)=2.51. The ice cream 2 should have a diameter of about 70 mm and a thickness of about 48.5 mm. The preferred dielectric properties for the brownie 1 are a value of E′=3.03 (dielectric constant) and a value of E″=0.67 (dielectric loss factor). The brownie 1 should have a diameter of about 72 mm and a thickness of about 14.5 mm. The preferred dielectric properties for the sauce 6 are a value of E′=8.41 (dielectric constant) and a value of E″=4.89 (dielectric loss factor). The sauce 6 should have a diameter of about 70 mm and a thickness of about 9 mm, and should be placed between the brownie 1 and the ice cream 2 in a generally cylindrical container 3 having a diameter of 70 mm and a total container height of about 81.5 mm.

A recessed lid or top 5 is preferably provided which is recessed about 9.5 mm, as shown in FIG. 1. The recessed top 5 is formed from a conductive material or covered by a conductive material, and effectively prevents microwaves from entering the top of the container 3. The gap between the top 5 and the shield 4 is small enough to prevent leakage of microwaves. The recessed design for the lid 5 also places the edges 33 of the lid 5 at a position remote from the shielded food material 2. If the lid 5 approaches resonance, voltage nodes or retransmitted fields which occur at the edges of the lid 5 will be spaced from the ice cream 2 to minimize or reduce the heating effect upon the ice cream 2.

The conductive top 5 preferably is circular, and has a diameter "$d_T$". The diameter "$d_T$" is selected so that:

$$\left(\frac{N}{d_T}\right)^2+\left(\frac{M}{d_T}\right)^2$$

is substantially not equal to $$\left(\frac{2}{\lambda_T}\right)^2,$$

where "N" and "M" are integers, for example, 0, 1, 2, 4, etc., and "$\lambda_T$" is the actual resonant wavelength of the microwaves in the conductive top 5.

For a rectangular top having a length "$l_T$" and a width "$w_T$", the dimensions are selected so that:

$$\left(\frac{N}{l_T}\right)^2+\left(\frac{M}{w_T}\right)^2$$

is substantially not equal to $$\left(\frac{2}{\lambda_T}\right)^2.$$

A conductive aluminum foil shield 4 should be provided with a preferred height of about 75 mm. An exposed wall 24 at the bottom of the container 3 is provided over the lower 6.35 mm of the container 3 in the illustrated embodiment. A small rim 27 at the top of the container 3 of about 0.15 mm would not be covered by the shield 4. In practice, it has been found that an unshielded rim 27 of 16 inch or more will usually allow leakage of microwaves to occur into the shielded zone 2.

The shield 4 preferably serves as a label for the package 21. The shield 4 may be imprinted with labeling information and bonded or adhesively affixed to the package in a conventional manner.

If desired, the shield 4 could be formed, e.g., by electroplating, so that the shield had no seam or gap, but instead formed a continuous conductive sheet around the container 3. This arrangement is not preferred because it is too costly.

For a frustoconical container 3′, as shown in FIG. 12, an ice cream 2 thickness of about 3.0 centimeters is preferred. A brownie 1 thickness of about 1.8 centimeters is preferred. A sauce 6 thickness of about 0.6 centimeters is also preferred.

Figure 10:
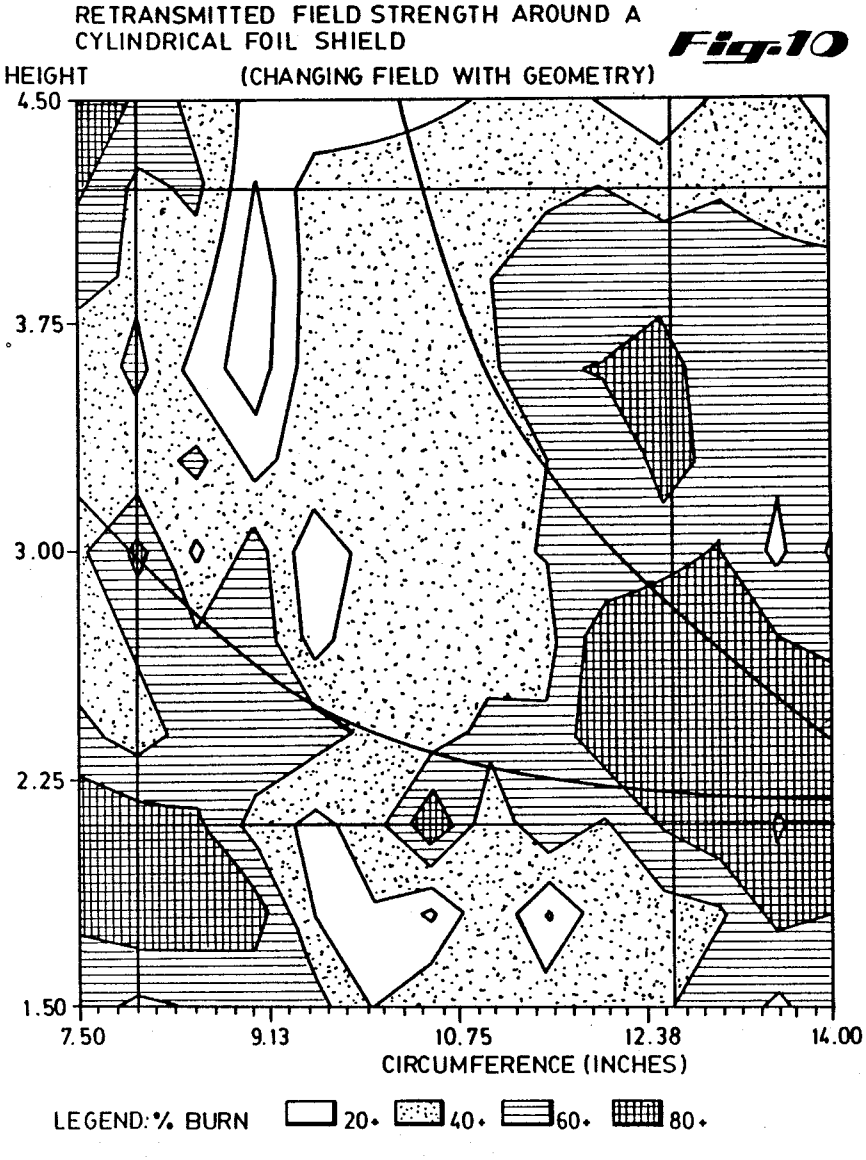
FIG. 10 is a graph illustrating field strength for a cylindrical shield as a function of the geometry of the shield.

FIG. 10 illustrates the results of experiments upon a variety of cylindrical containers 3 having shields 4 wrapped around the containers 3. The cylinders were tested for hot spots by coating the package with cellulose acetate. The particular cellulose acetate compound employed turned dark at 290° F. The graph of FIG. 10 illustrates the amount of blackening that occurred over the aluminum foil shielded cylinder 3, as observed by the reaction of the acetate material to heating. This experiment provided further information concerning the susceptibility of the package to adverse effects of resonance, retransmitted fields, and arcing. This graph may be used as a basis for selecting a favorable combination of dimensions for a package.

Figure 11:
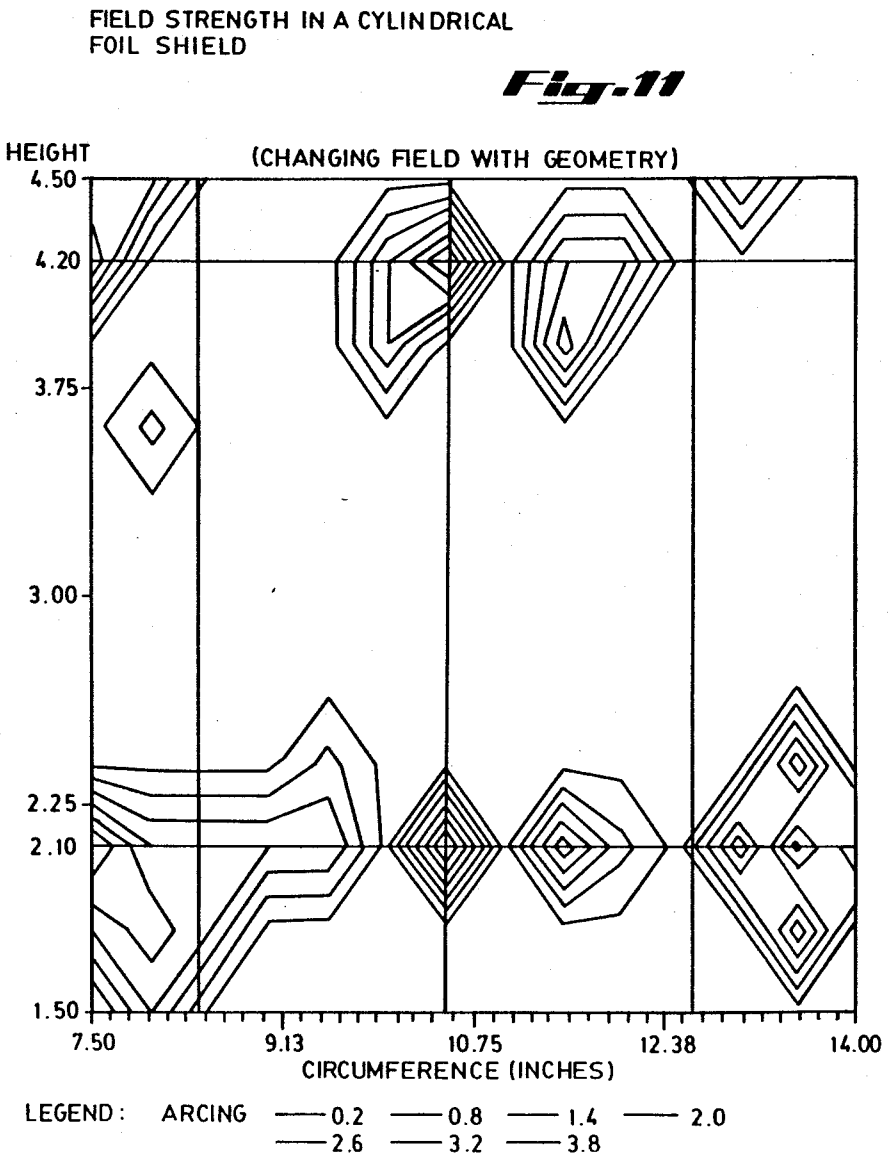
FIG. 11 is a graph illustrating the field strength for a cylindrical shield as a function of the geometry of the shield.

FIG. 11 illustrates the amount of arcing for various heights and circumferences in a cylindrical shield constructed from aluminum foil. The test was conducted at 2450 MHz. Approximately 140 different cylinders were tested, and the amount of arcing was rated or scored as follows: 0=no arcing at all; 1=a single spark was observed; 2=intermittent sparking; 3=continuous sparking; and 4=the package started on fire. This experiment indicated that the most severe arcing occurred where the height of the foil was equal to approximately 2.1 inches and approximately 4.2 inches.

A suitable alternative embodiment of a frustoconical container which has given satisfactory results in practice is shown in FIG. 13 and FIG. 14. The indicated dimensions are in inches. This particular container 3' has a 7° taper on its side walls, thereby forming a frustoconical container 3'. A frustoconical shield 4' would be formed around the walls of the container 3', as illustrated in FIG. 12. The shield height "h" is measured parallel to the surface of the shield 4'.

Figure 16:
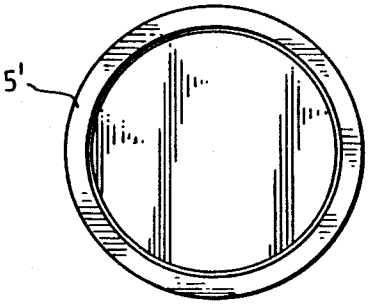
FIG. 16 is a top view of the container lid illustrated in FIG. 15.
Figure 15:
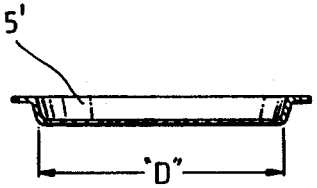
FIG. 15 is a side view of the container lid for the container illustrated in FIGS. 13 and 14.

FIG. 15 and FIG. 16 illustrate a suitable top 5' for the container 3'. The dimensions are in inches.

Figure 17:
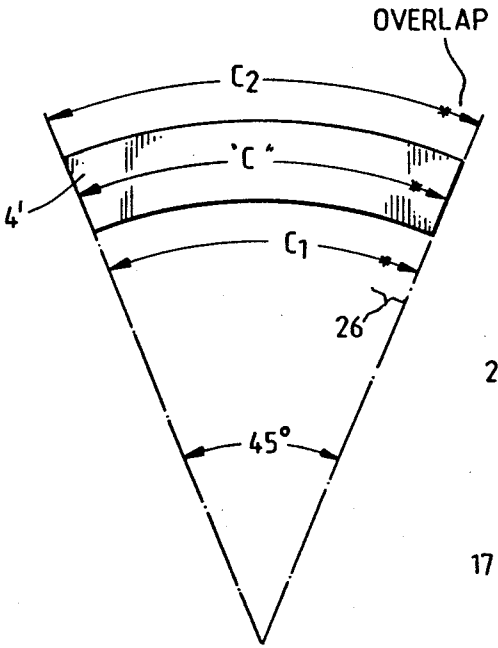
FIG. 17 illustrates the dimensions for a conductive shield to be wrapped around the frustoconical container illustrated in FIG. 13.

A suitable shield 4' is illustrated in FIG. 17. For the frustoconical container 3' illustrated in FIG. 13, the shield 4' is formed as illustrated in FIG. 17. The shield has a mean circumference "C". The shield 4' has a minimum circumference "$C_1$" and a maximum circumference "$C_2$", with "$C_2$" being the largest value in the range of circumferences. The portion 26 of the shield 4' which overlaps is not included in the measurement of the effective circumference "C" of the shield 4'.

In the case of a tapered container 3', or frustoconical container 3', the circumference "C" of the shield 4' varies over a range, being larger near the top 5' of the container 3' and smaller near the bottom of the container 3'. The mean circumference "C" of the shield 4' may be measured at the center of the shield 4' in the illustrated example of FIG. 12. The shield 4' will also have a mean diameter "D" when it is wrapped around the container 3'. The shield 4' will have a minimum diameter "$d_1$", which in the illustrated embodiment shown in FIG. 12 is measured at the bottom of the shield 4'. The shield 4' will have a maximum diameter "$d_2$", which is measured at the top of the shield 4' in the illustrated embodiment.

When selecting a frustoconical shield 4', a range of diameters "$d_1$" through "$d_2$" and a range of circumferences "$C_1$" through "$C_2$" must be considered. The above discussion with respect to cylindrical shields applies to a frustoconical shield 4' except that a mean circumference "C" and mean diameter "D" should be considered, and preferably arcing will be avoided for any diameter within the range "$d_1$" through "$d_2$", and for any circumference within the range "$C_1$" through "$C_2$".

In this particular alternative embodiment, the dimensions have been selected to optimize the temperature differential for the food materials 1 and 2. The height "h" dimension approaches resonance for this shield 4'. But such resonance, where optimization of temperature differential requires it, may result in melting of the container 3', scorching at the lower edge of the shield 4', etc. These undesirable effects of resonance can be controlled by an "air gap" technique described below.

Figure 18:
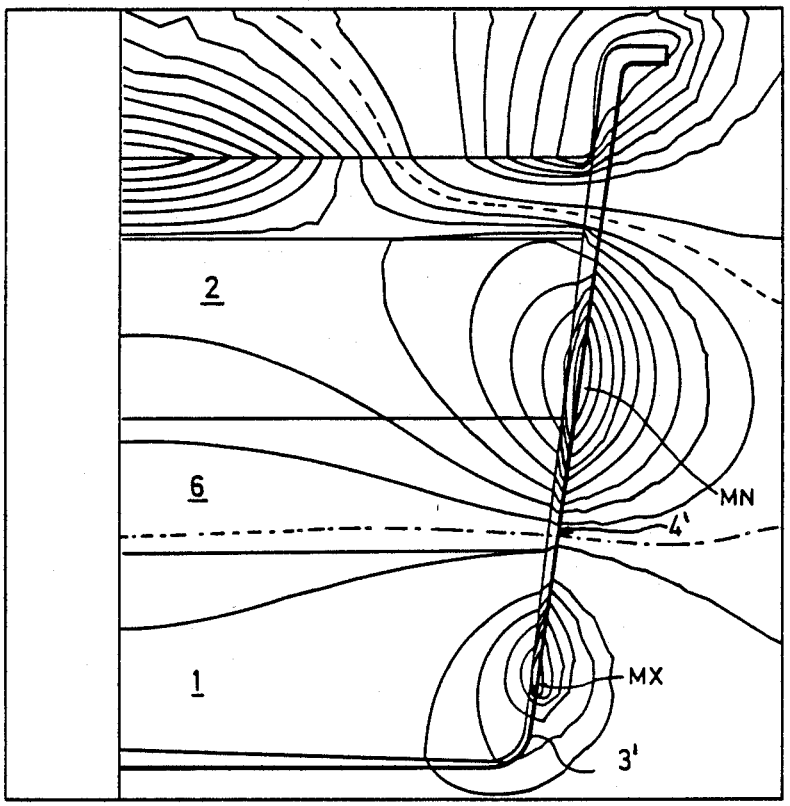
FIG. 18 is a computer-generated graph illustrating the electrical field around a shielded container which has various food substances present therein, and in which no gap exists between the container and the food substance at the bottom of the container.

The "air gap" technique is another technique for avoiding detrimental effects of retransmitted microwave fields. It involves the use of air gaps 16 near the edges of the shield 4'. This may be best understood by referring to the graph shown in FIG. 18. In this example, where there is no gap between the brownie 1 and the bottom of the container 3', a maximum voltage equal to 10,000 volts is assumed at the edge of the shield 4', indicated generally by the reference "MX" in FIG. 18. A computer-generated electric field is illustrated for a shielded container 3'. In the close-up of the maximum voltage region "MX" shown in FIG. 19, a field line equal to 6,000 gauss is shown going through the brownie 1. Thus, high strength fields are present in the brownie 1, and may cause heating of the brownie 1. If the heating effect upon the brownie 1 is too severe, it may adversely affect both the food material 1 and the container 3'. The food material 1 may be scorched, the food material 1 may be overheated near the lower edge of the shield 4', the container 3' may be melted near the lower edge of the shield 4', and in extreme cases such heating can even cause burning of the container 3'.

Figure 20:
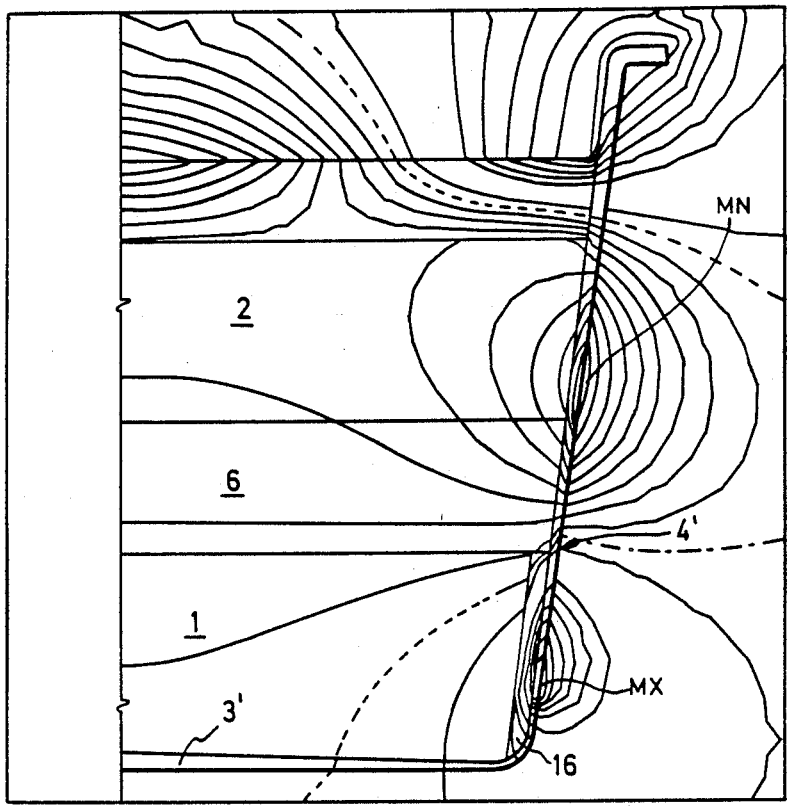
FIG. 20 is a computer-generated graph illustrating the electrical field around a shielded container which has a 1/16 inch gap between the container and the food substance at the bottom of the container.
Figure 21:
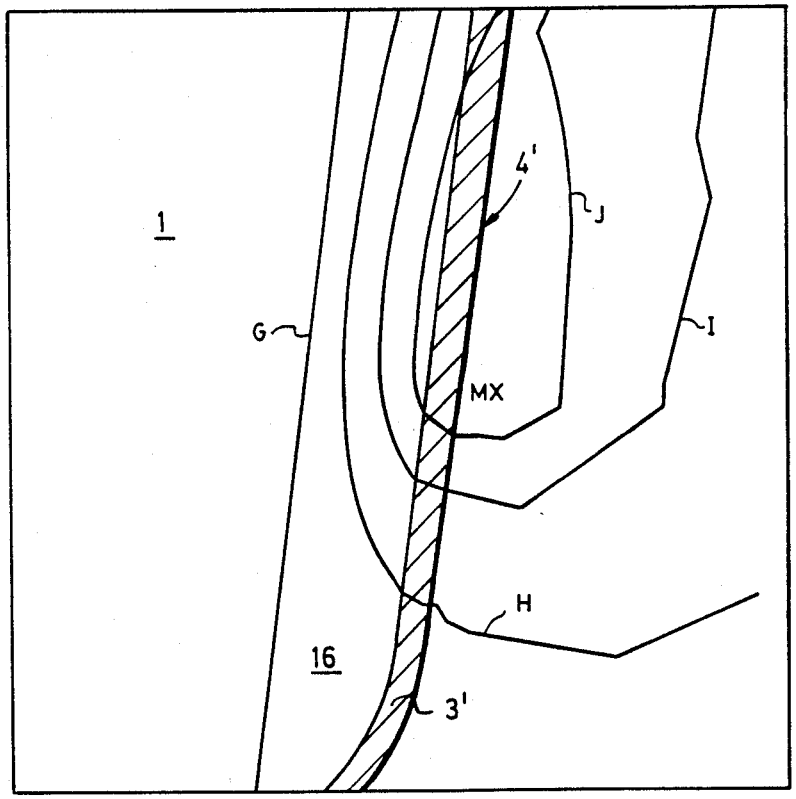
FIG. 21 is a computer-generated graph illustrating a close-up view of the lower portion of the graph of FIG. 20.

FIG. 20 illustrates the effect of an air gap 16 upon the computer-generated graph of electrical field strength. The gap 16 is an air gap formed between the first food material 1, (i.e., the brownie 1), and the side wall of the container 3'. In this case, the strongest portion of the electrical field appears in the air gap 16, and does not contribute to heating of the brownie 1. A close-up view of this graph is shown in FIG. 21. The field lines of 6,000 gauss and even 4,000 gauss cut through the air gap 16. The field line of 2,000 gauss barely cuts through the surface of the brownie 1. Thus, the tendency of the brownie 1 to become overheated in this region is greatly reduced. In other words, the high field strength generated near the edge of the shield 4' at the maximum voltage point "MX" does not overheat the brownie 1 due to the presence of the air gap 16.

Figure 19:
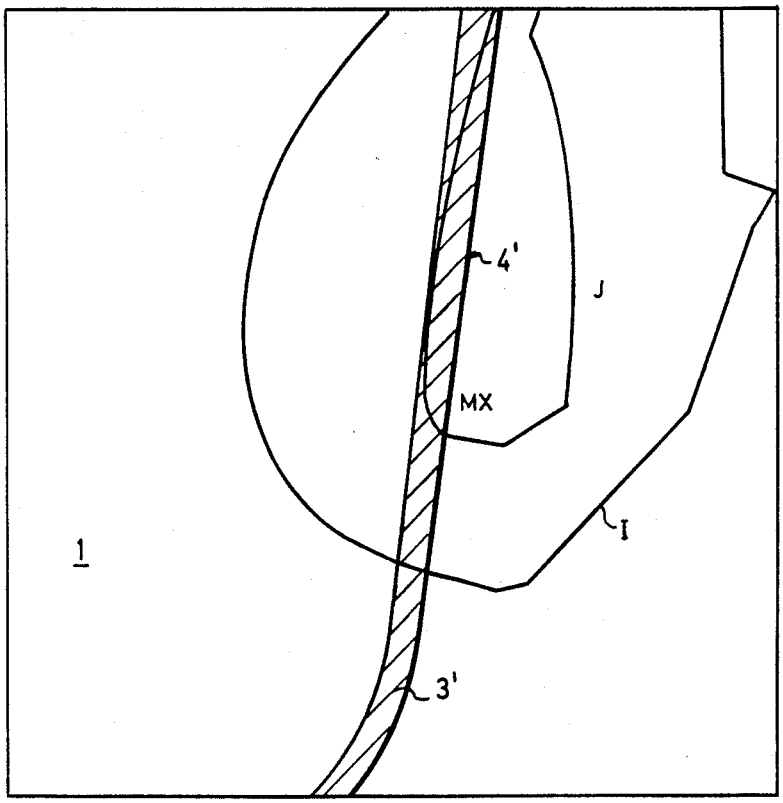
FIG. 19 is a computer-generated graph illustrating a close-up view of the lower portion of the graph of FIG. 18.

In the example illustrated in FIG. 19, the field line of 6,000 gauss cuts substantially into the depth of the brownie 1 and contributes substantially to the heating of the brownie 1. By comparison, in the example illustrated in FIG. 21, the field line of 6,000 gauss cuts through the air gap 16 without any substantial heating effect upon the brownie 1.

Figure 22:
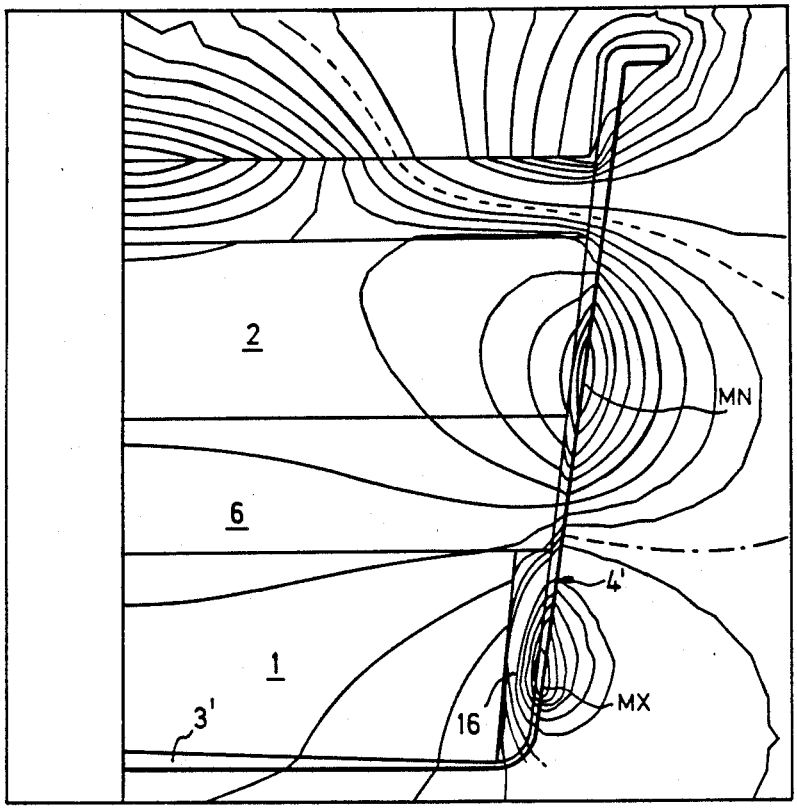
FIG. 22 is a computer-generated graph illustrating the electrical field around a shielded container where a ⅛ inch gap is provided between the container and the food substance at the bottom of the container.
Figure 23:
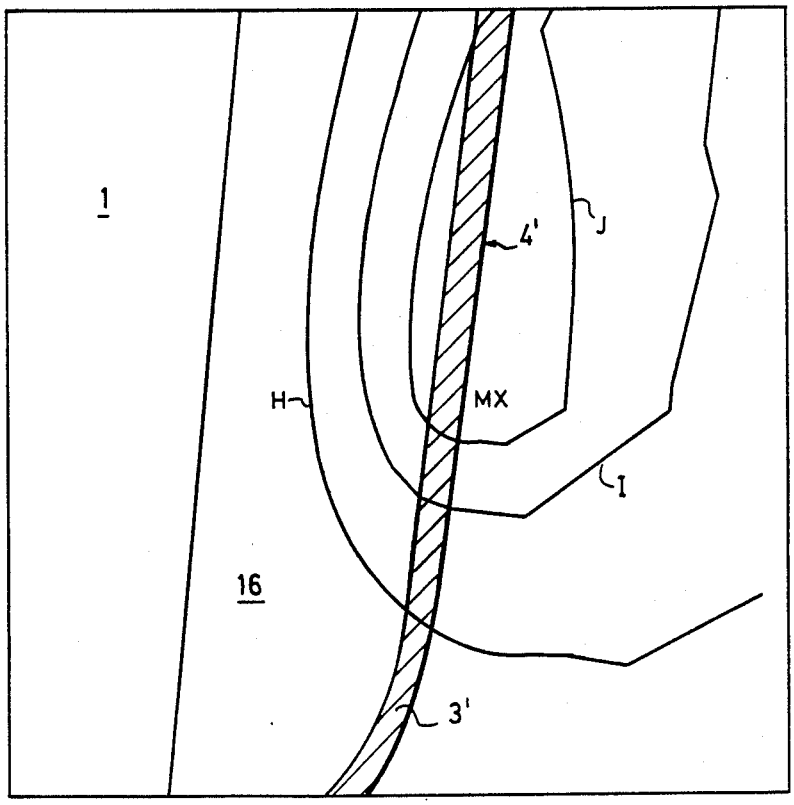
FIG. 23 is a computer-generated graph illustrating a close-up view of the lower portion of the graph of FIG. 22.

FIG. 22 illustrates a computer-generated graph for the electrical field strength where the air gap 16 is $\frac{1}{8}$ inch. Even more of the electrical field strength surrounding the maximum "MX" cuts through the air gap 16. This is shown by the close-up illustration of FIG. 23. In this example, even the field lines representing a value of 2,000 gauss do not cut through the surface of the brownie 1.

The air gap technique may be utilized in instances where the height "h" of the shield 4 approaches a resonant length.

Although the above discussion has referred to this technique as the "air gap technique", the same principle will work with any low loss, low dielectric material 16 immediately adjacent to the edge of the shield 4'. Air is the preferred material, and the most convenient.

Figure 24:
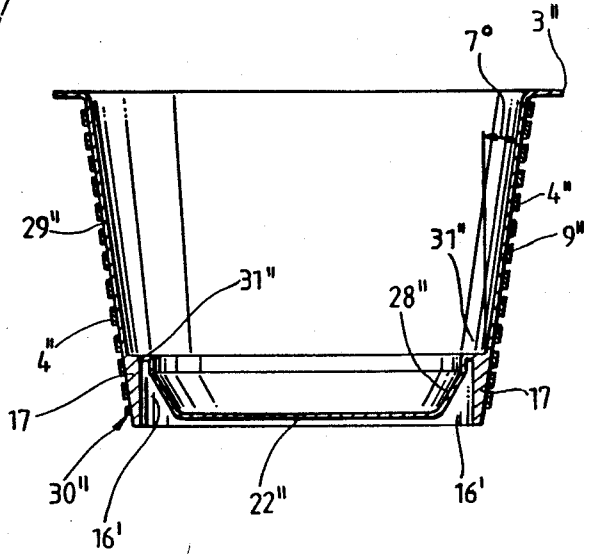
FIG. 24 is a cross-sectioned cut-away view of an alternative embodiment of a frustoconical container having air gap means at the bottom rim of the container.

FIG. 24 illustrates an alternative embodiment of a container 3'' which utilizes the air gap technique to minimize overheating of the food material in the bottom of the container 3''. This container 3'' uses air gap means 16' to avoid overheating of the container 3'' if the shield 4'' dimensions approach resonance sufficiently to realize substantial fields at the lower edge 30'' of the shield 4''. The container 3'' has a lower shoulder or rim 17 which forms an air gap 16' between the bottom 22'' of the container 3" and the lower edge of the shield 4". The bottom 22" is preferably flat in the center and tapers upwardly over a recessed region 28" to adjoin the sidewall 29" of the container 3" at a point 31" remote from the lower edge 30" of the shield 4". The shield 4" is wrapped around the outside of the sidewalls 29" of the container 3".

Alternatively, an air gap 16 may be formed as in FIG. 20 by cooking the brownie 1 in a container having a taper which is larger than the taper of the container 3'. This is not the preferred method for utilizing the air gap technique, because the sauce 6 may melt and fill the air gap 16 and thus defeat the benefits of the air gap technique.

The use of a tapered container 3' as shown in FIG. 12 and FIG. 13 allows the selective use of resonant dimensions to improve the temperature differential between the first food material 1 and the second food material 2. A tapered container 3' allows the package to be designed to have a single horizontal diameter, for example $d_1$, which resonates at the point where the first food material 1 is desired to be heated. Other diameters, i.e., the diameters of the container 3' corresponding to the location of the second food material 2 in the range from $d_2$ to $d_3$ shown in FIG. 12, are selected to be nonresonant diameters. Thus, the resonant diameter $d_1$ at the lower edge of the shield 4', corresponding to the position of the brownie 1, assists in heating of the brownie 1, while the diameters of the shield 4' in the area of the container 3' where the ice cream 2 is located in the range from $d_2$ to $d_3$ are nonresonant.

Optimum performance of a shielded food package when heated by microwave radiation can also be affected by standing waves within the microwave cavity of the microwave oven. Product performance may be enhanced by utilizing standing waves generated between the floor of the oven and the food material 1 in the container 3. Not only is the brownie diameter (for example $d_1$) important, but the brownie thickness is also important. If the distance between the floor of the microwave oven and the shelf containing the package is approximately 1.2 inches, this will be equal to about one-quarter wavelength of the microwaves in air, (which is virtually the same as in free space). In this example, the brownie 1 should preferably be made 0.7 inch thick, (i.e., the brownie 1 height equals about 0.7 inch). This is because the one-quarter wavelength of the microwaves in question in the brownie material 1 is about 0.7 inch due to the particular properties of the brownie 1. This construction is especially effective if a highly reflective sauce 6 is interposed between the brownie 1 and the ice cream 2. Sauce layers 6 capable of reflecting 60–80% of the microwave energy back down to the brownie 1 are theoretically attainable.

A tapered container 3' as shown in FIG. 12 also provides some tolerance, so that if the shield 4' does resonate for a particular diameter $d_n$, the shield 4' will not resonate over its entire length "h", but will only resonate in one horizontal plane. This provides some tolerance for the construction of the package, which is a desirable attribute for a package intended for home use where microwave ovens may vary.

The brownie 1 may be baked in a pan of suitable size and transferred to the container 3 for packaging. Alternatively, cost savings may be realized by breaking the brownie 1 into pieces and packing the pieces into the bottom of the container 3.

The shield 4 should preferably have a height "h" within the range of about 2.4 inches to about 3.6 inches. A range of heights "h" for the shield 4 between about 2.5 inches to about 3.5 inches is more preferred. An even more preferred range of heights "h" is between about 2.6 inches to about 3.4 inches. A shield 4 height "h" between about 2.8 inches to about 3.2 inches is especially preferred. There is apparently no significant effect upon the preferred height "h" of the shield 4 where the container 3 is a cylindrical container, as illustrated in FIG. 1, as compared to a frustoconical container 3', as illustrated in FIG. 12.

The diameter "D" for the shield 4 should preferably be within the range of about 2.8 inches to about 3.6 inches. An even more preferred diameter "d" for the shield 4 is in the range of about 2.9 inches to about 3.4 inches. A diameter "D" for the shield 4 within the range of about 3.0 inches to about 3.2 inches is especially preferred.

For an overlapping shield, as illustrated in FIG. 3, an overlapping distance "L" of about ½ inch may provide satisfactory results. An overlapping distance "L" within the range of about 0.05 inch to about 1.5 inches is preferred. An amount of overlap "L" of about 0.1 inch to about 1.5 inches is more preferred. An amount of overlap "L" within the range of about 0.5 inch to about 1.5 inches is especially preferred.

Where the frequency of a microwave oven is 2450 MHz, the wavelength $\lambda_0$ will be known. In such an instance, the expression $DhLK \div 4d\lambda_0^2$ may be simplified to $DhLK \div 92.16d$.

Referring to FIG. 1, the thickness of the brownie layer 1 is preferably 14.5 millimeters. A thickness for the brownie layer 1 within the range of about 11 millimeters to about 18 millimeters will provide satisfactory results. A thickness for the ice cream layer 2 within the range of about 40 millimeters to about 57 millimeters is preferred. A thickness for the ice cream layer 2 within the range of about 43 millimeters to about 54 millimeters is more preferred. A thickness for the ice cream layer 2 equal to about 48.5 millimeters is especially preferred. The sauce layer 6 may have a thickness between about 8 millimeters and about 10 millimeters. A thickness of about 9 millimeters for the sauce layer 6 is preferred.

In a preferred embodiment, the shield 4 is formed by wrapping a single piece of aluminum foil around the container 3. However, if desired, the shield 4 may be constructed from two or more pieces of aluminum foil. Each piece of aluminum foil may overlap the adjoining piece, as shown in FIG. 3 for a one-piece label 4. The use of a plurality of labels appears to provide equivalent results, and appears to behave substantially the same as a one-piece shield 4.

In an experiment to compare varying amounts of overlap "L", strips of foil were formed into loops. A length of foil forming a loop one and one-half wavelengths in circumference was utilized. This loop was then wrapped around a paper cylinder, which was used as a lossy material to be heated by the regenerated fields induced in the foil. A temperature sensitive transparent paper was then placed over the foil to mark the location of the areas of the foil strip which exceeded 290° F. Cellulose acetate was used as the temperature sensitive transparent material. The strip was microwaved for 10 seconds. The following table summarizes the results, where the column marked "% Burn" represents the percent of the temperature sensitive material which turned dark (as a result of exceeding 290° F.).

| Overlap | Capacitance | Relative Arcing Potential | Arcing | % Burn |
|---|---|---|---|---|
| 0 | 0 F | 1.00 | X | 60% |
| 0.02 | $1.4 \times 10^{-12}$F | .93 | X | 54% |
| 0.05 | $3.6 \times 10^{-12}$F | .86 | | 36% |
| 0.10 | $7.1 \times 10^{-12}$F | .74 | | 27% |
| 0.2 | $1.4 \times 10^{-11}$F | .63 | | 25% |
| 0.5 | $3.6 \times 10^{-11}$F | .46 | | 16% |

Arcing occurred where the amount of overlap was 0 or 0.02 inch. Where the overlap was 0.05 inch or greater, no arcing occurred. In other words, where the relative arcing potential was equal to 0.86 or less, no arcing occurred. In summary, without an overlap, or with a slight overlap, the test strips arced and the transparent temperature sensitive paper darkened. With a larger overlap, arcing was eliminated and the retransmitted fields were reduced.

Figure 8:
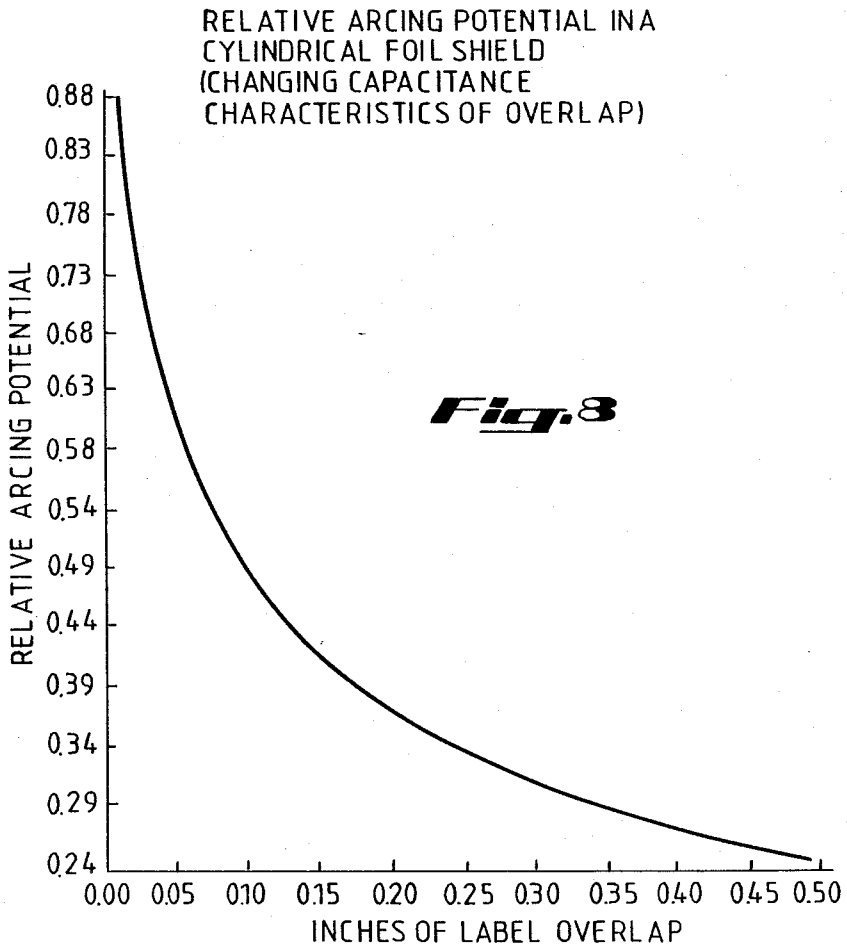
FIG. 8 is a graph depicting the relationship between relative arcing potential and the amount of overlap of the ends of a shield.

Foil loops of different circumferences were tested in the method described above. A one-half inch overlap was used with these loops. None of the loops arced and resonances only occurred at multiples of a full wavelength, where potential differences do not exist across the capacitor formed by the overlapping ends of the shield. The results of this experiment are summarized in FIG. 9. The effect of the amount of overlap "L" upon the relative arcing potential is summarized in FIG. 8.

Further details concerning microwave food products relevant to this invention may appear in patent application Ser. No. 922,573, entitled "Food Product and Method of Manufacture", by John R. Weimer, filed contemporaneously herewith, the entire disclosure of which is incorporated herein by reference.

The above disclosure has been directed to a preferred embodiment of the present invention. The invention may be embodied in a number of alternative embodiments other than those illustrated and described above. A person skilled in the art will be able to conceive of a number of modifications to the above described embodiments after having the benefit of the above disclosure and having the benefit of Applicant's teachings. The full scope of the invention shall be determined by a proper interpretation of the claims, and shall not be unnecessarily limited to the specific embodiments described above.

What is claimed is:

1. A method of determining resonant lengths of microwave shielding material, comprising the steps of:

constructing a laminate test strip including a length of conductive shielding material, a strip of lossy material, and a strip of temperature indicating material; and, irradiating the laminate test strip with microwave radiation for a predetermined period of time to determine the heating response of the laminate test strip, whereby the amount of heating provides an indication of a resonant length of said test strip.

2. The method according to claim 1, further comprising the step of:

selecting cellulose acetate for the strip of temperature indicating material.

3. A method of determining resonant lengths of microwave shielding material, comprising the steps of:

constructing a plurality of laminate test strips having a plurality of different lengths of conductive shielding material, each length of conductive shielding material being bonded to a strip of lossy material and a strip of a temperature sensitive indicator;

irradiating the laminate test strips with microwave radiation for a predetermined period of time;

evaluating relative temperature indications of the temperature sensitive indicators of the strips to determine resonant lengths of conductile shielding material which provide the maximum relative temperature indication of the amount of heating of the irradiated laminated test strips.

4. The method according to claim 3, further comprising the step of:

determining resonant lengths of conductive shielding material by measuring the lengths which provide the maximum relative temperature indication.

5. The method according to claim 4, further comprising the step of:

constructing a shielded food container for heating food in a microwave oven by avoiding resonant lengths in conductive shielding material used to shield the food container.

6. The method according to claim 3, further comprising the step of:

selecting cellulose acetate for the strip of a temperature sensitive indicator.

7. The method according to claim 6, wherein: the lengths of conductive shielding material have a width that is substantially less than a half wavelength.

8. The method according to claim 3, wherein:

the lengths of conductive shielding material have a substantially uniform width.

9. The method according to claim 3, wherein:

the lengths of conductive shielding material have a width that is substantially less than a half wavelength.

10. The method according to claim 9, wherein:

the conductive shielding material is aluminum.

* * * * *

UNITED STATES PATENT AND TRADEMARK OFFICE

CERTIFICATE OF CORRECTION

PATENT NO. : 4,934,829

DATED : June 19, 1990

INVENTOR(S) : Dan J. Wendt

It is certified that error appears in the above—identified patent and that said Letters Patent is hereby corrected as shown below:

Column 1, line 15, after "container" and before the period, insert -- intended for use in a microwave oven --.

Column 8, line 11, "x" should be -- $\pi$ --.

Column 9, line 57, "to" should be -- not --

Column 19, line 44 "70" should be -- 72 --; line 53, "70" should be -- 72 --; line 56, "70" should be -- 72 --.

Column 20, line 16, "0, 1, 2, 4," should be -- 0, 1, 2, 3, 4, --; line 40, "16" should be -- 1/16 --; line 47, after "by" insert -- sputter coating or --

Column 26, line 20, after "time;" insert -- and, --; line 23, "conductile" should be -- conductive --; line 26, "laminated" should be -- laminate --.

Signed and Sealed this

Twentieth Day of August, 1991

*Attest:*

*Attesting Officer*

HARRY F. MANBECK, JR.

*Commissioner of Patents and Trademarks*